US010053114B2

(12) United States Patent
Lieber

(10) Patent No.: US 10,053,114 B2
(45) Date of Patent: Aug. 21, 2018

(54) PROTECTIVE WALL FOR THE PROTECTION OF PEOPLE FROM MOVING RAIL VEHICLES

(71) Applicant: Christoph Lieber, Lucerne (CH)

(72) Inventor: Christoph Lieber, Lucerne (CH)

( * ) Notice: Subject to any disclaimer, the term of this patent is extended or adjusted under 35 U.S.C. 154(b) by 84 days.

(21) Appl. No.: 14/898,477

(22) PCT Filed: Jun. 2, 2014

(86) PCT No.: PCT/EP2014/061408
§ 371 (c)(1),
(2) Date: Dec. 14, 2015

(87) PCT Pub. No.: WO2014/198579
PCT Pub. Date: Dec. 18, 2014

(65) Prior Publication Data

US 2016/0207542 A1 Jul. 21, 2016

(30) Foreign Application Priority Data

Jun. 14, 2013 (CH) ..... 1128/13

(51) Int. Cl.
*B61B 1/02* (2006.01)
*E06B 11/02* (2006.01)

(52) U.S. Cl.
CPC ..... *B61B 1/02* (2013.01); *E06B 11/022* (2013.01)

(58) Field of Classification Search
CPC ..... B61B 1/02; E06B 11/022; E06B 11/025; E01F 13/048
USPC ..... 49/374
See application file for complete search history.

(56) References Cited

U.S. PATENT DOCUMENTS 909,791 A * 1/1909 Heppner ..... B61B 1/02 104/31
1,245,061 A * 10/1917 Strieter ..... B61L 29/284 246/126
4,690,583 A * 9/1987 Faulconer ..... E01D 19/103 404/12
5,009,542 A * 4/1991 Hardin, Jr. ..... E01F 15/12 404/6

(Continued)

FOREIGN PATENT DOCUMENTS

JP H067764 U 8/1994
JP 2008279967 A 11/2008

(Continued)

*Primary Examiner* — Katherine W Mitchell
*Assistant Examiner* — Abe L Massad
(74) *Attorney, Agent, or Firm* — Hard IP LLC

(57) ABSTRACT

A protection device for the protection of people against moving rail vehicle in a railway station area comprises an inner and an outer protective wall (11, 12, 76, 77, 88, 89). The station area contains a platform (4) whereby the platform (4) contains a platform edge (2, 22). A first side of the platform edge (2, 22) has tracks and a second side of the platform edge (2, 22) has a platform plateau (23). The platform plateau (23) is designed as a waiting area for people. The protective wall (11, 12, 76, 77, 88, 89) is directly adjacent or near to the platform edge (2, 22) and between a retracted state and an extended state adjustable in such a way that in the extended state (11, 12, 76, 77, 88, 89) access to the tracks is obstructed, in the retracted state access to the tracks is free.

15 Claims, 38 Drawing Sheets

(56) References Cited

U.S. PATENT DOCUMENTS

| | | | | |
|---|---|---|---|---|
| 6,105,905 | A * | 8/2000 | Spence | B61L 29/04 104/28 |
| 6,227,523 | B1 * | 5/2001 | Haberlen | E01F 13/048 246/127 |
| 7,685,772 | B2 * | 3/2010 | Ohata | B61B 1/02 49/362 |
| 8,387,541 | B2 * | 3/2013 | Losito | B61B 1/02 104/28 |
| 2008/0117043 | A1 * | 5/2008 | Van Den Abeele | B61B 1/02 340/540 |
| 2010/0098486 | A1 * | 4/2010 | Miracle | E01F 15/085 404/6 |
| 2016/0312532 | A1 * | 10/2016 | Kuhnl-Kinel | E06B 11/025 |

FOREIGN PATENT DOCUMENTS

| | | | |
|---|---|---|---|
| WO | 2005102808 | A1 | 11/2005 |
| WO | 2008149246 | A1 | 12/2008 |

* cited by examiner

PROTECTIVE WALL FOR THE PROTECTION OF PEOPLE FROM MOVING RAIL VEHICLES

CROSS-REFERENCE TO RELATED APPLICATION

This application is a U.S. National Phase application under 35 U.S.C. 371 that claims priority to PCT Application Number PCT/EP2014/061408, filed on Jun. 2, 2014, which claims priority of CH Application Number 1128/13, filed on Jun. 14, 2013, which are all incorporated herein by reference in their entirety.

BACKGROUND

The invention concerns a protective wall for the protection of people, who are located for example on a platform of a railway station, from moving rail vehicles such as metro trains, tramways or trains.

Nowadays, on modern metro systems the protection of people from approaching or passing rail vehicles is solved in such a way that on the platform, doors are installed which open in horizontal alignment in the manner of sliding doors as soon as the passenger train stopped. In the literature they are called platform edge doors or platform screen doors. Such a system is known from EP 2 164 738 B 1. WO2005/102808 A1 shows a platform gate door combined with footboard which is retractable into the platform foundation. When the rail vehicle is stopped, the platform gate door is lowered into the platform foundation. The footboard is located at the upper end of the door and forms in the lowered position a connection between the rail vehicle and the platform, so that passengers may cross the gap between the rail vehicle and the platform edge without accident.

JP1994057764U shows a safety fence retractable into the platform foundation.

The condition for the installation of platform screen doors is, that the passenger trains always stop within centimeters exactly in the same place and that all passenger trains have the same distance between the doors. Thus, the change of passengers can always take place at a certain place, which is defined by the position of the platform screen doors.

The present invention seeks to offer passengers and mechanical protection against moving rail vehicles at locations where the installation of platform screen doors is not possible because:

- The rolling stock used has different distances between the doors or
- The passenger trains cannot stop precisely or
- The railway company doesn't want to accept the loss of time by the precise stopping.

In JP1994057764U a safety fence for the protection of people against moving rail vehicles in a station area is revealed, where the station area has at least one platform, the platform has at least one platform edge and on a first side of the platform edge tracks for a rail vehicle are arranged and on the second side of the platform edge extends a platform plateau which is designed as a waiting area for people. A safety fence is located at the edge of the platform. The safety fence is between a retracted state and an extended state so adjustable that in the extended state an access to the tracks is obstructed, in the retracted state the access to the tracks is free. This means that the safety fence can take at least two different positions, the retracted state and the extended state.

The two positions differ from each other as the height of the safety fence in the retracted state is smaller than in extended state.

SUMMARY

The present invention is based on the task to make it impossible through a retractable protective wall for persons situated on the platform to access the track area and thereby protect them from passing trains.

A disadvantage of the known solutions lies in the fact that they are not suitable to protect passengers waiting on the platform from passing rail vehicles. Because a passing rail vehicle creates a pressure wave, one would like to avoid walls in the immediate proximity of the rail vehicle. The retractable walls would be deformed or be vibrated by the pressure load whereby the drive or the wall could suffer damage.

In particular, it is therefore an object of the invention to provide a protection device which is also suitable for protection against passing express trains, freight trains or similar rail vehicles for which in the station area no stop is scheduled.

The invention concerns a protection device for the protection of people from moving rail vehicles in a station area. The station area contains at least one platform, the platform contains at least one platform edge. On a first side of the platform edge tracks for a rail vehicle or arranged and on the second side of the platform edge extends a platform plateau which is designed as a waiting area for people, whereby at or near the platform edge a protective wall is arranged which is adjustable between a retracted state and an extended state so that in the extended state and access to the tracks is prevented, in the retracted state the access to the tracks is free. The protective wall comprises an inner protective wall and an outer protective wall, whereby in particular the outer protective wall is located between the platform edge and the inner protective wall or the outer protective wall forms the edge of the platform or is located immediately adjacent to the platform edge.

The inner protective wall is located at a greater distance to the platform edge than the outer protective wall. Two protective walls additionally represent a redundant system. The redundancy causes a reduction of the risk that in case of failure of the protective device by a faulty drive it comes to the situation that the only protective wall remains in the retracted position and the transport operation must be interrupted until the faulty drive repair is done.

In particular, the protective wall is height-adjustable. The extended state corresponds in particular to the maximum height of the protective wall and the retracted state corresponds in particular to the minimum height of the protective wall.

According to an embodiment, in the retracted state the protection device is housed in a cavity. This cavity is located in this embodiment below the platform plateau. In this way, any blocking of the rail vehicle by a protective wall situated in an incorrect position can be avoided. In addition, the protective wall can be stored in a space-saving manner inside the platform. Thus, there is no additional space requirement for the protective wall. It can be easily integrated into existing buildings or installed on existing buildings, if a sufficient distance still remains between the rail vehicle and the protective wall. For this purpose, the cavity is placed advantageously in the interior of the platform below the platform plateau.

The protective wall or in each of the protective walls may have at least a driving device. In this way, each of the protective walls are controlled independently of one another.

According to an embodiment, the driving device may comprise at least one drive cylinder, which may be pneumatically, hydraulically or electrically actuated. The driving device is advantageously placed in the cavity, so that it is largely shielded from the weather conditions or an unauthorized access. The driving device may in particular comprise a single or multistage drive cylinder, which may be hydraulically or pneumatically actuated, or a vertical drive, in particular a linear vertical drive. An electrically driven linear vertical drive is for example provided as a driving device for vertical movement. Such a driving device may for example comprise a linear module with a ball rail system or a roller guide with a ball screw drive or a toothed belt drive. Also other guides and drive systems are possible.

According to an embodiment, in the extended state, the protective wall can slide from the platform edge towards the platform plateau. This allows to obtain a greater distance between the platform edge and the protective wall, thereby resulting in a greater distance to the rail vehicle. This larger space between the rail vehicle and the protective wall can be used to smoothen the air pressure, which occurs when a rail vehicle passes the protective wall at high speed. In the retracted state, the protective wall can be accommodated in a cavity. The cavity may be located below the platform plateau. The cavity can be made accessible through a removable plate element. For easy maintenance for the driving device, a walk passage is provided in the cavity which can be covered by the removable plate elements. The removable plate element is advantageously equipped with a locking mechanism. In particular, a pillar may be positioned in the cavity, which can serve as a support for the removable plate elements.

According to an embodiment, there is placed at least at one of the protective walls a sensing element, for example a pressure sensor, a light barrier, an active infrared detector or another type of sensor or a warning element, for example a warning light or a triggering element, for example a push button or an indicating element, for the example a display with or without interactive operating function.

For controlling the driving device, a control element may be provided which is connected with an interlocking.

Between the outer protective wall and the inner protective wall a mechanical system may be arranged to seal the space between the outer protective wall and the inner protective wall. In particular, the mechanical system can be configured as an extendable intermediate element. The extendable intermediate element may include a frame, which consists of two frame components and a spring element. The spring element may be stretched or compressed by the movement the frame components. The two frame components may be mutually insertable, like a telescope.

One of the protective walls can be fitted with a hinged flap by which the space between the protective walls can be covered. The hinged flap can be integrated into the outer protective wall or be fixed onto a separate support element. For example, the hinged flap can be part of the outer protective wall. According to a variant, a support element is provided which is movable concurrently with the protective wall or independently thereto. A sensor may be provided on the protective wall or on the hinged flap. In particular, a fixation to the rear wall of the outer protective wall or support element may be provided, so that of the outer protective wall or the support element are only retractable if the hinged flap is in a pulled-back state. The length of the hinged flap is at least equal to the distance between the outer protective wall and the inner protective wall, so that the space between the outer protective wall and inner protective wall can be covered. The push-out movement of the hinged flap can be triggered by one of the following options: through a drive at the mounting of the hinged flap on the outer protective wall at the upper end of the hinged flap, through a rotatable horizontal pole, whereby the rotatable horizontal pole is connected with a drive below the hinged flap, through a spring element, through an auxiliary pole, through a retractable bollard.

According to an embodiment, at least one of the inner or outer protective walls can be designed in several parts. In particular, each of the protective walls may consist of a multiplicity of wall pieces. The division may result in that one of the protective walls consists of a multiplicity of poles of diverse height or diverse length. In particular, the protective wall may consist of a multiplicity of intermateable wall elements. Between the outer protective wall and the inner protective wall a multiplicity of retractable intermediate walls may be arranged.

According to an embodiment one of the inner or the outer protective walls and the plane of the platform plateau include an angle of less than 90°. In particular, a tilting device may be provided to convert at least one of the inner or outer protective walls from a vertical position into an inclined position.

According to an embodiment, retaining elements may be arranged in the interspace between the inner and outer protective wall.

The inner protective wall may comprise a continuous protective wall or may comprise poles standing close together. Standing close together means in this case a distance of two adjacent poles of up to 25 cm.

A method of operation of a protective device for the protection of people from moving rail vehicles in a station area contains the following steps: a protective wall begins to descend as soon as the rail vehicle approaches the station area and/or the approach velocity has decreased below 20 km/h and/or an actuating signal to operate a driving device is received, when the rail vehicle reaches its stop position, the protective wall descends completely to the retracted state, after the protective wall reached the retracted state the doors of the rail vehicle may open, so that a passenger exchange can take place, a signal to leave the retracted state is transmitted to the driving device of the protective wall, as soon as no more passengers are between the protective wall and the rail vehicle and the signal to close the doors has been transmitted, the protective wall is lifted to the extended state and the rail vehicle begins to move as soon as the protective wall has reached its extended state.

The term: "approaching the station area" is intended to mean in particular that the rail vehicle has already reached the station area or has reached a track section where the entry into the station area is already signaled.

In particular according to an embodiment, the protective wall may be configured in several parts, that means, that at least one of the inner or outer protective wall may contain a multiplicity of segments. Shortly before the entry of the rail vehicle the outer protective wall may get lifted. As soon as of the outer protective wall has been lifted, inner protective wall can be lowered, and shortly before the passenger exchange the outer protective wall is lowered again into the retracted state, so that the passenger exchange can take place as soon as the inner and of the outer protective wall are in the retracted state. The segments are lifted or lowered sequentially, until the protective wall has reached its maximum height or the protective wall is lowered below the level of the platform edge.

The rail vehicle begins to move only after the outer protective wall is in the extended state. In particular the signal to the lift the protective wall can be linked to the signal to close the doors of the rail vehicle. The protection device may be equipped with a transmitter and/or a receiver interact with the rail vehicle.

In particular the lifting process of the outer protective wall can be triggered by a forced door closing in the rail vehicle and/or the lowering of the outer protective wall can be triggered by a door release control system. According to a variant, the outer protective wall may start to get lifted before all the doors of the rail vehicle are closed. According to an additional variant the protective wall may get lifted after all the doors of the rail vehicle are closed.

In particular, at least one of the protective walls contains sensors which detect the speed of the rail vehicle and/or its distance to the stop position.

If the passenger exchange is completed and of the outer protective wall in the extended state, a mechanical system can be moved until the mechanical system has a sufficiently large slope so that in the further course people standing on the platform are pushed safely to the platform-oriented side of the inner protective wall. The mechanical system gets lifted with the same speed as the inner protective wall and as soon as a protective wall reached its extended state, the outer protective wall and the mechanical system start to descend to the platform plateau level. In particular, the outer protective wall may get lifted before a rail vehicle reaches the station area whereby the mechanical system remains at the level of the platform plateau, whereby after the lowering of the inner protective wall the outer protective wall is lowered to the retracted state again before the passenger exchange. The mechanical system may contain an extendable intermediate element, a hinged flap or a multiplicity of intermediate walls which can be lifted with the aid of a drive. The mechanical system contains a track-oriented frame component and a platform-oriented frame component, whereby the track-oriented frame component and the platform-oriented frame component and the inner protective wall get lifted with the same speed so that the inclination of the mechanical system remains constant.

Additionally to the advantage of the increase of safety for passengers in a station area the protective wall may also be used as a noise barrier, shielding passengers against operating noise caused by passing rail vehicles. A further advantage of the use of such a protective wall is to provide a splash guard. If rail vehicles pass the station area with high speed, precipitations, such as water drops or snowflakes are transported by the air stream generated by the rail vehicle onto the platform plateau, whereby passengers may be subjected to splashes. These water drops would drain off on the track-oriented side of the protective wall and would therefore not reach the platform plateau.

Preferably the protective wall consists of a transparent material. The protective wall can be made of Plexiglas or contain acrylic glass elements so that the visibility for the driver and the passengers is restricted is little as possible.

Advantageously, the protective wall may be composed of the multiplicity of modules. Depending on the length of the platform a different number of modules may be arranged one behind the other. Each of the modules can be made of segments, which can get lifted or lowered sequentially. Advantageously, the protective wall has a height of at least 0.5 m so that it can't be easily climbed over. The protective wall currently has a maximum height of 2.5 m.

BRIEF DESCRIPTION OF THE DRAWINGS

Hereafter, embodiments of the invention are explained with reference to the drawings.

Therein show.

DETAILED DESCRIPTION

Figure 1A:
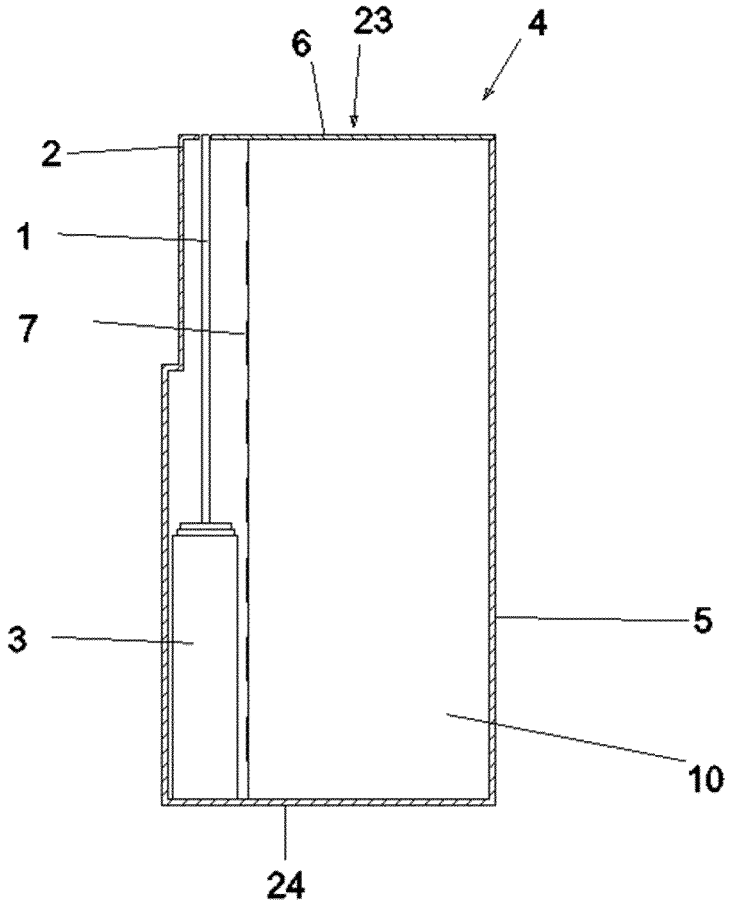
FIG. 1*a* a first embodiment of the platform with an integrated protective wall and a drive cylinder in the retracted state, FIG. 1*b* the first embodiment in the extended state, FIG. 1*c* a view of the arrangement of the drive cylinders and pillars in the first embodiment, FIG. 1*d* a second embodiment with two protective walls, FIG. 1*e* a second embodiment with two protective walls, FIG. 1*f* a view of the arrangement of the drive cylinders and pillars according to the second embodiment, FIG. 2*a* a second embodiment of a platform with two integrated protective walls and linear vertical drives in the retracted state. State during the passenger exchange, FIG. 2*b* the second embodiment with the outer protective wall as a closure of the platform edge, FIG. 2*c* the second embodiment, whereby the outer protective wall gets lifted, the inner protective wall is in the retracted state, FIG. 2*d* the second embodiment, whereby the outer protective wall is in the extended state, the inner protective wall gets lifted, FIG. 2*e* the second embodiment, whereby both protective walls are in the extended state, FIG. 2*f* the second embodiment, whereby the outer protective wall is lowered, the inner protective wall is in the extended state, FIG. 2*g* the second embodiment, whereby the outer protective wall is a retracted state, the inner protective wall is in the extended state, thus the situation when trains pass the platform without a stop, FIG. 2*h* the second embodiment, whereby the outer protective wall gets lifted, the inner protective wall is in the extended state, FIG. 2*i* the second embodiment, whereby the outer protective wall is in the extended state, the inner protective wall is lowered, FIG. 2*j* the second embodiment, whereby the outer protective wall is in the extended state, the inner protective wall is in the retracted state, FIG. 2*k* the second embodiment, whereby the outer protective wall is lowered, the inner protective wall is in the retracted state, FIG. 2*l* the second embodiment, whereby the outer protective wall is in the retracted state, the inner protective wall is lowered, FIG. 2*m* the second embodiment as a central platform whereby tracks are arranged on both sides of the platform; the outer protective wall is in the retracted state, the inner protective wall is in the extended state, thus the situation when trains pass the platform without a stop, FIG. 3*a* a third embodiment with two protective walls and a passively extendable element of the platform between the protective walls, whereby the outer protective wall is in the extended state, the intermediate element and the inner protective wall get lifted, FIG. 3*b* the third embodiment, whereby the outer protective wall and the intermediate element are lowered, the inner protective wall is in the extended state, FIG. 3*c* the extendable element between the protective walls according to the third embodiment in the extended and retracted state, FIG. 3*d* the third embodiment with an own linear vertical drive for the extendable intermediate element, FIG. 4*a* a fourth embodiment with a hinged flap integrated in the outer protective wall, whereby the outer protective wall gets lifted, the flap is in the pushed-out position, the inner protective wall gets lifted, FIG. 4*b* the fourth embodiment with a retractable auxiliary pole which supports the flap push-out movement, FIG. 4*c* the fourth embodiment, whereby the hinged flap gets pulled back, the outer protective wall is lowered, the inner protective wall is in the extended state, FIG. 5*a* a fifth embodiment with two multi-part extendable protective walls, whereby the outer multipart extendable protective wall is in the retracted state, the inner multipart extendable protective wall is in the extended state, FIG. 5*b* a view of the arrangement of the drive cylinder, the driving mechanism in the support elements of the inner or outer protective wall in the retracted state according to the fifth embodiment, FIG. 5*c* a view of the arrangement of the drive cylinder, the driving mechanism and support elements of the inner or outer protective wall in the extended state in the fifth embodiment, FIG. 5*d* the fifth embodiment with an extendable intermediate element with its own drive between the multi-part extendable protective walls, FIG. 5*e* the fifth embodiment with a hinged flap installed on a separate support element between the multipart extendable protective walls, FIG. 5*f* the fifth embodiment, whereby the outer and inner protective wall consist of intermateable elements, FIG. 6*a* a sixth embodiment with several integrated retractable intermediate walls between the outer protective wall and the inner protective wall, FIG. 6*b* the sixth embodiment with several multi-part extendable intermediate walls between the multi-part extendable outer protective wall and the multi-part extendable inner protective wall, FIG. 7*a* a seventh embodiment with two slanted integrated protective walls with a linear vertical drive, FIG. 7*b* the seventh embodiment, whereby the inner protective wall is mounted on the carriage and is able to slant inwardly in the extended state, FIG. 7*c* the seventh embodiment, whereby the inner protective wall is mounted on the carriage and is tilted in the extended state.

FIG. 1*a* shows a cross-section of a railway platform with an integrated protective wall 1. The protective wall 1 forms the closure of the platform edge 2 or is positioned so close to the platform edge 2 of the platform 4 that during the lifting process of the protective wall 1 people who stand on the platform plateau 23 near to the platform edge 2 cannot fall into the track area.

The protective wall 1 is mounted on a drive cylinder. The drive cylinder is connected with the driving device which is not shown in the drawing. The drive cylinder is used for moving the protective wall 1 from a retracted position to an extended position. In the extended position, the protective wall 1 is in the extended state, which can also be called a protection state. In the retracted position, the protective wall 1 is in the extended state, which can also be called a protection state. In the retracted position, the protective wall 1 is in the retracted state. In the retracted state the protective wall 1 may be overcome by the passengers without difficulties because it doesn't overtop the surface which forms the platform 4.

As a driving device for the vertical movement there is used for example an electrically powered drive cylinder, a pneumatically powered drive cylinder or a hydraulically powered drive cylinder. The protective wall 1 and a drive cylinder 3 are shielded by a shell 5. The protective wall 1 in the retracted state and the driving device are covered by the shell 5 in a cage like manner. The shell 5 is limited on the track side by a border wall which forms of the platform edge 2. The bottom of the shell 5 forms its floor 24. The upper side of the shell 5 comprises at least partially a removable plate 6, which is walkable. The shell 5 is platform sided limited by the foundation of the platform 4. The shell 5 therefore forms the outer boundary of a cavity. One or a multiplicity of pillars 7 are arranged vertically in the cavity. A reception element 9, for example a tube, is used as a reception for a pole 8 and can be used as a duct for the pole 8. The reception element 9 is arranged between the drive cylinders 3 and forms a vertical guidance. Two such reception elements are shown in FIG. 1*c*, they are hidden by the drive cylinders 3 in FIGS. 1*a* or 1*b*. The pole 8 is connected to the protective wall 1 and is used to stabilize the shape of the protective wall and/or for stiffening of the protective wall 1. By the use of one or several of such poles 8 the stability of the protective wall against bulges, buckling or other types of deformation can be increased.

Behind the drive cylinder 3 and the protective wall 1 a cavity 10 is located, so that in case of failure repair work can be done. The cavity is part of the shell 5 and is shaped as a walkable free space.

In case of using a pneumatically powered the driving device, the compressor and the compressed air tank are also located in the cavity 10, which is not shown in the drawings. On the upper side, that means on the level of the platform plateau, a plate 6 which can swing upwardly is installed between the protective wall 1 and the shell 5. The plate 6 which can swing upwardly is supported by pillars 7 which are fixed on the floor 24 of the shell 5. The plate 6 which can swing upwardly is usually closed and can be opened by authorized specialists only. In the retracted state the protective wall 1 is flush with the level of the platform plateau. By the vertical movement of the drive cylinder 3 the protective wall 1 gets lifted. At the top of the protective wall 1 pressure sensors may be installed which can stop, if required, the word movement of the protective wall 1.

Figure 1B:
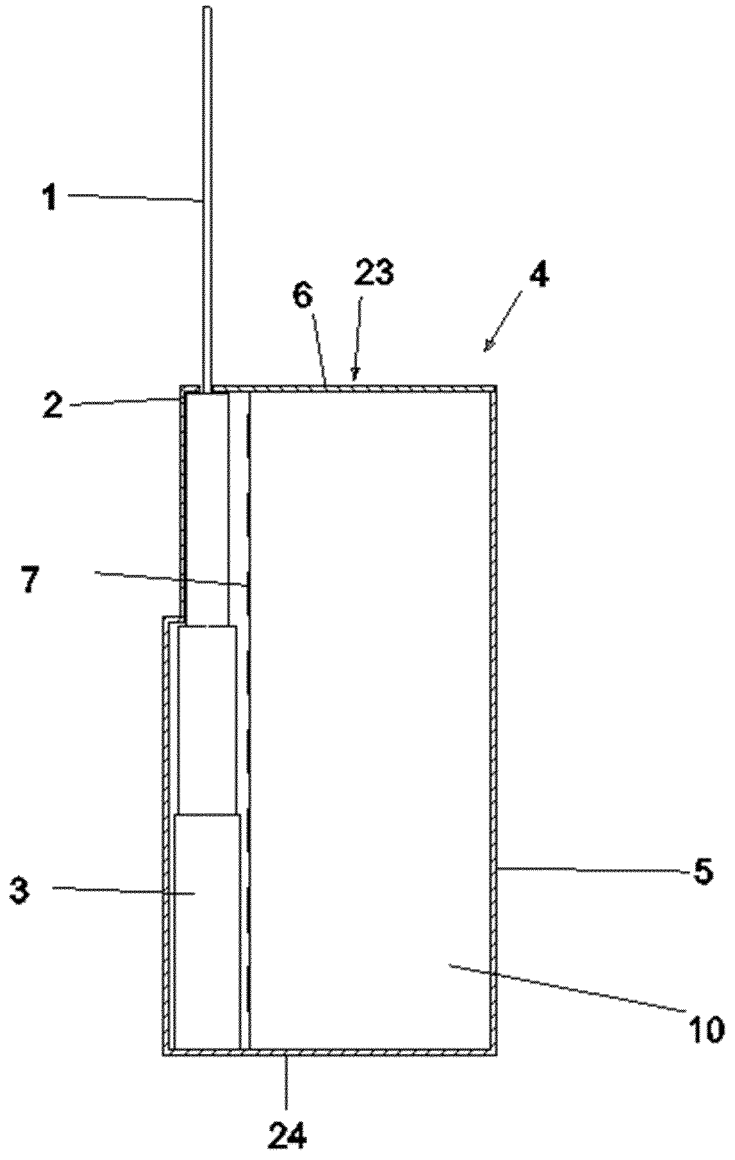
Figure 1C:
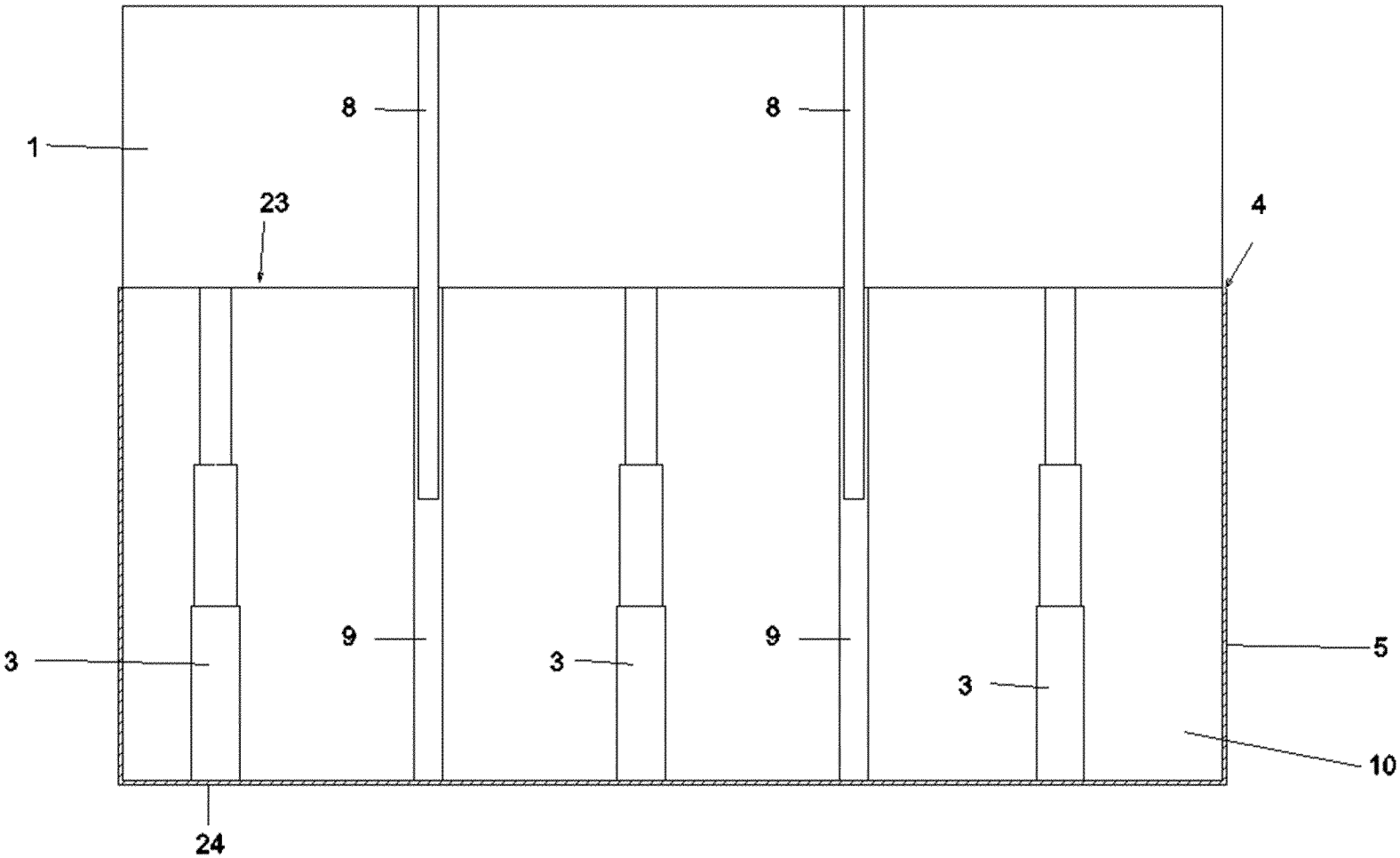

FIG. 1*b* shows the construction in the extended protection state. The track area and the platform area are mechanically separated by the protective wall 1.

FIG. 1*c* shows the first embodiment of the protective wall 1 in the extended state from the side. Poles 8 lead from the upper edge of the protective wall 1 two below the lower edge of the protective wall 1 for the stability of the protective wall 1. The poles 8 are guided in the reception elements 9 which are formed as tubes. The reception elements 9 are arranged between the drive cylinders. The reception elements 9 may be integrated into the shell 5. The length of the poles 8 from the bottom of the protective wall 1 to the end of the pole 8 must not be greater than the height of the drive cylinders 3 in the retracted state. The reception elements 9 have a lateral slot which corresponds to the height of the retractable protective wall 1. Below the level of the protective wall 1, the poles 8 may be guided in rails in the front and at the back of the reception elements 9, which gives them an additional stability.

In the embodiments described as following, analogous parts are provided with the same reference signs so that a detailed description of these parts is not necessary.

Figure 1D:
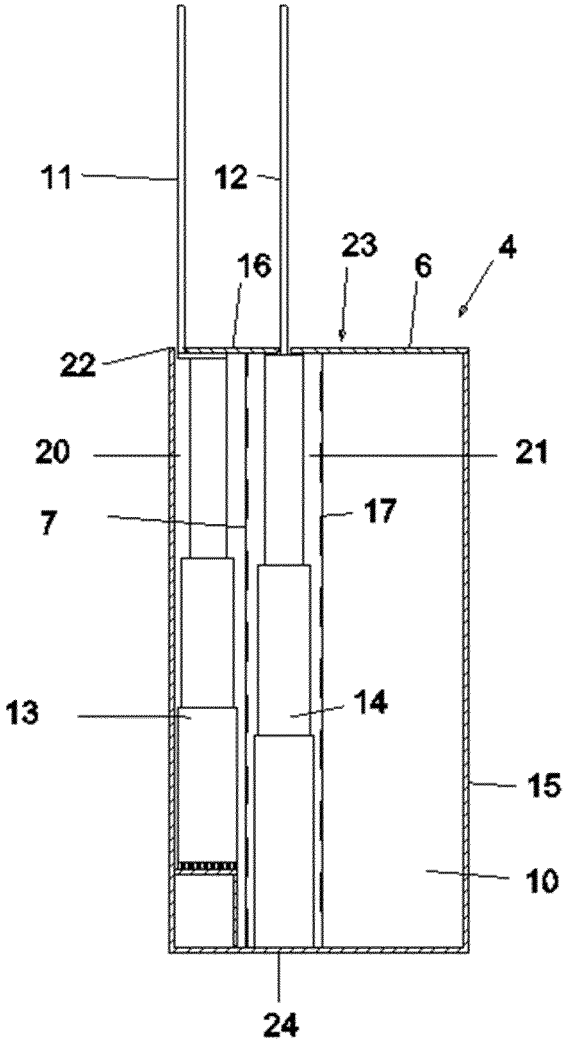

In the embodiment according to FIG. 1*d* there is installed additionally to the protective wall 11 directly adjacent to the platform edge like in FIGS. 1*a*, 1*b* and is a second protective wall 12 with a greater distance to the platform edge. The protective wall 11 directly adjacent to the platform edge 22 is called the outer protective wall 11. The second the protective wall 12 with a greater distance to the platform edge 22 is called the inner protective wall 12. The outer protective wall 11 and the inner protective wall 12 are mounted on the drive cylinders 13, 14 and are stabilized by poles.

The driving device may be placed in one of the cavities 10, 20, 21 of the shell 15 which is not shown in the drawings. On the upper side, that means on the level of the platform plateau, a plate 6 which can swing upwardly is installed between the protective wall 12 and the shell 15. The plate 6 which can swing upwardly is supported by pillars 17, which are fixed to the floor of the shell 15. The pillars 7, 17 divide the interior space limited by the shell into three cavities 10, 20, 21. On the upper side a plate 16 which can swing upwardly is installed between the outer protective wall 11 and the shell 15. The plate 16 which can swing upwardly is supported by pillars 7 which are fixed on the floor 24 of the shell 15. The platform edge 22 forms the track-sided boundary of the cavity 20. The plates 6, 16 which can swing upwardly are usually closed and can only be opened by an authorized specialist. In the retracted state the inner protective wall 12 is flush with the level of the platform plateau. In the same way, the retracted state of the outer protective wall is 11 is flush with the level of the platform plateau. By the vertical movement of the drive cylinder 14 the inner protective wall 12 gets lifted. The drive cylinder 14 and the inner protective wall 12 are placed into the cavity 21 which is delimited by the pillars 7. By the vertical movement of the drive cylinder 13 the outer protective wall gets lifted. The drive cylinder 13 and the outer protective wall 11 are placed the interior of the cavity 20 which is bounded by the wall, which forms the platform edge 22, and laterally by the pillars 7.

A subsidiary element may be arranged between the drive cylinder and that the protective wall so that the outer protective wall 12 may form the track-sided boundary of the platform 4. This subsidiary element is movable together with the outer protective wall. The outer protective wall is positioned slightly offset relative to the drive cylinder 13 and is passed through an opening in the plate 16.

At the top of each of the protective walls 11, 12 pressure sensors may be installed which stop, if required, the upward movement of each of the protective walls. The drive cylinder 14 of the inner protective wall 12 may be arranged diagonally offset relative to the drive cylinders 13 of the outer protective wall 11. The chronological sequence of the vertical movements of the two protective walls is as follows:

During the passenger exchange the protective walls 11, 12 are in the retracted state.

After completion of the passenger exchange firstly the outer protective wall 11 gets lifted.

If the outer protective wall 11 is in the extended state, also the inner protective wall 12 gets lifted. The advantage of a system according to FIG. 1*d* compared to a system with only one protective wall 1 as shown in FIGS. 1*a*-1*c* is that after the lifting process of the protective wall no people stay on the wrong, track-oriented side of the protective wall 12. A prerequisite is, that the distance between the inner protective wall 12 and the outer protective wall 11 is not too large or the space between the protective walls 11, 12 is supervised. In particular the distance between the rail vehicle and the outer protective wall 11 may be at least 5 cm. The distance between the rail vehicle and the outer protective wall 11 should not be more than 10 cm, so that no passenger can be pinched into gap between the rail vehicle and the outer protective wall 11. The distance between the inner protective wall 12 and the outer protective wall 11 may be up to 50 cm, preferably up to 30 cm. The greater the distance between the inner protective wall 12 and the outer protective wall 11 is, respectively the platform edge 22, the higher is the reduction of the air pressure created by a passing rail vehicle.

If both protective walls 11, 12 are in the extended state, the outer protective wall 11 can be lowered. Now only the inner protective wall 12 is in the extended state. The advantage is that passing rail vehicles can pass at high speed. Between the inner protective wall 12 end of the passing rail vehicle an upwardly open channel is formed through which the air compressed by the rail vehicle can escape, and any air overpressure can be avoided.

In a system used with only one protective wall 1 directly adjacent to the platform edge 2 of the platform 4 like the one shown in FIGS. 1*a*-1*c*, a laterally directed force acts on the wagon wall of the rail vehicle, caused by the compressed air created by passing rail vehicle. Because of the small distance between the wagon wall and the protective wall 1 a higher pressure may cause damage to the protective wall if rail vehicles pass at high speed.

Is possible to provide openings on the protective wall to reduce the air pressure. However, openings have the disadvantage that they may be a certain potential risk for people, in particular objects may interlock with the openings.

The method of operation of a protective wall for the protection of people from moving rail vehicles in a station area for example according to the embodiments according to one of the FIGS. 1*a*-1*d* contains the following steps:

As soon as the rail vehicle approaches the station area, reaches the station area and/or the approach velocity slows below 20 km/h, the protective wall respectively of the outer protective wall 11 and the inner protective wall 12 start to be lowered. If the protective wall 1 or each of the protective walls 11, 12 are completely lowered, the doors of the rail vehicle may be opened and a passenger exchange can take place. As soon as no more passengers are situated between the protective wall and the rail vehicle, the protective wall 1, respectively 11, gets lifted. As soon as the protective wall 1, respectively 11, is lifted, the rail vehicle starts to move again.

The method of operation of a protective wall for the protection of people from moving rail vehicles in a station area according to the embodiment which is shown for example in FIG. 1*d* contains the following steps:

Shortly before the entry of a rail vehicle with passenger exchange the outer protective wall 11 gets lifted. As soon as the outer protective wall 11 has been lifted, the inner protective wall 12 begins to get lowered. Shortly before the passenger exchange also the outer protective wall 11 is lowered again. The passenger exchange can take place.

Instead of a system with two protective walls also an embodiment would be possible which contains a system with three or more protective walls which work according to the chronological sequence analogously as it has been described in the first or second embodiments. Alternatively a system may be used with an outer protective wall which can slide. In the extended state, the outer protective wall slides on a rail from the platform edge towards the platform interior. This variant according to a fourth embodiment can be used advantageously if very high velocities of passing rail vehicles require a great distance between the protective wall and the wagon wall of the rail vehicle.

A further application possibility is that the protective wall installed directly at the adjacent to the platform edge is lowered shortly before the stop of the rail vehicle with passenger exchange, and that after the passenger exchange, the rail vehicle starts to move only after the protective wall is again in the extended state.

This application possibility would reach a level of safety similar to platform screen doors. In order that this application possibility results in the desired increase of safety, the following conditions have to be met:

- The distance between the wagon wall and the protective wall is sufficiently small, so that no persons can be pinched between the rail vehicle and the platform.
- The rail vehicle is equipped with an automatic door closing system with crush protection and condition monitoring in the driver's cab with a vehicle immobilizer if the doors are opened.
- The rail vehicle has a continuous smooth outer surface, also between the wagons. These requirements meet according to today's state-of-the-art only electrical multiple units (EMU) with wagons not separable in commercial operation.
- The rail vehicle is equipped with a transmitter and a receiver to control the vertical movement of the protective wall.
- The driver's cab of the electric multiple unit is equipped with two buttons for the side selective door release control and a button for the forced door closing with condition monitoring.
- The protective wall is equipped with a transmitter and a receiver to interact with the rail vehicle.

The passenger exchange process according to one of the embodiments would proceed as follows:

Shortly before the stop of the rail vehicle, the protective wall 1, 11 directly and adjacent to the platform edge is lowered. The protective wall receives the command to be lowered by following options:

- In the track pressure sensors are installed. As soon as the rail vehicle has passed a defined track section, the command to be lowered is transmitted to the protective wall.
- The rail vehicle transmits the command to be lowered to the protective wall as soon as the rail vehicle has slowed down below a defined velocity, for the example 20 km/h.
- The rail vehicle transmits the command to be lowered to the protective wall as soon as the train driver has pressed the door release button.

The protective wall should be in the retracted state before the rail vehicle stands still. As soon as the protective wall is completely lowered, it transmits a signal to the rail vehicle. If the protective wall is completely lowered, that means the protective wall is in the retracted state, and the rail vehicle stands still, the doors may be opened.

After completion of the passenger exchange, the train driver presses the button for the forced door closing, the rail vehicle transmits the command to get lifted to the protective wall.

One option is that the protective wall gets lifted and as soon as the train driver presses the button for the enforced door closing, that means, that the protective wall gets lifted before all the doors are closed.

A second option is that the rail vehicle transmits the command to get lifted to the protective wall only after all the doors are closed. This would increase the level of safety, but would prolong the station dwell time of the rail vehicle.

After having reached the extended state, the protective wall transmits a signal to the rail vehicle. Are also all the doors closed, then the vehicle immobilizer in the driver's cab of the rail vehicle is released and the rail vehicle can start to move.

If the train driver wants to pick up more passengers after pressing the button for enforced door closing, he can press the door release button, so the protective wall receives the command to be lowered and the departure process starts again.

Figure 1E:
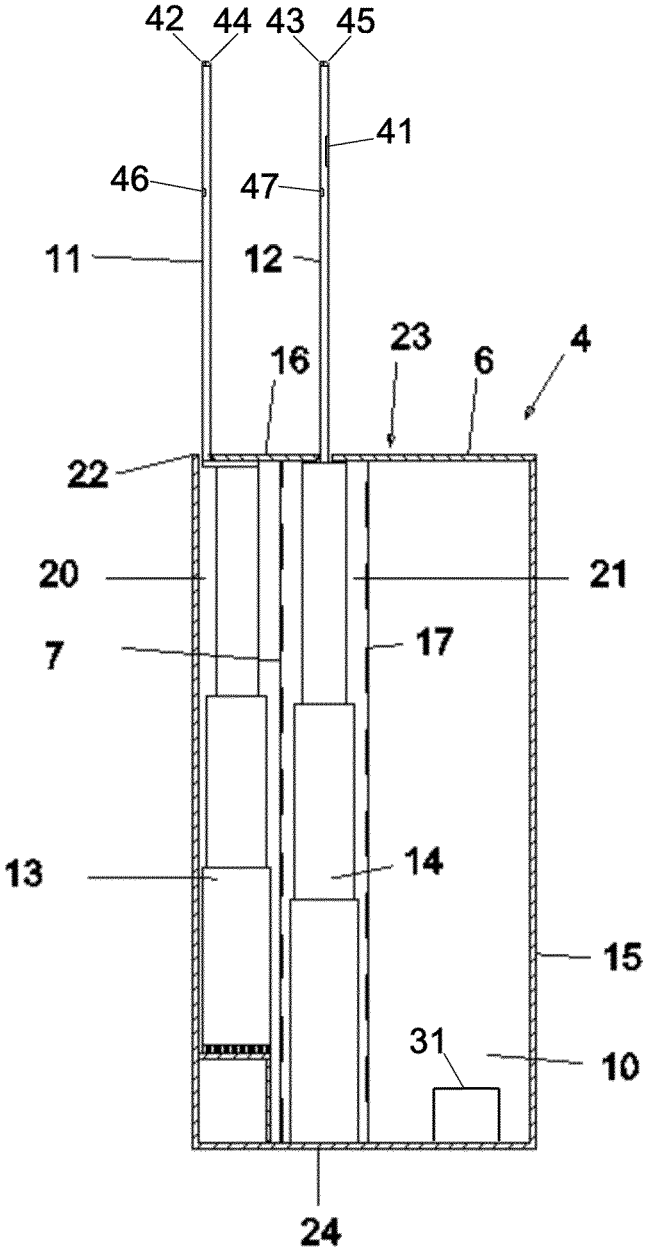
Figure 2A:
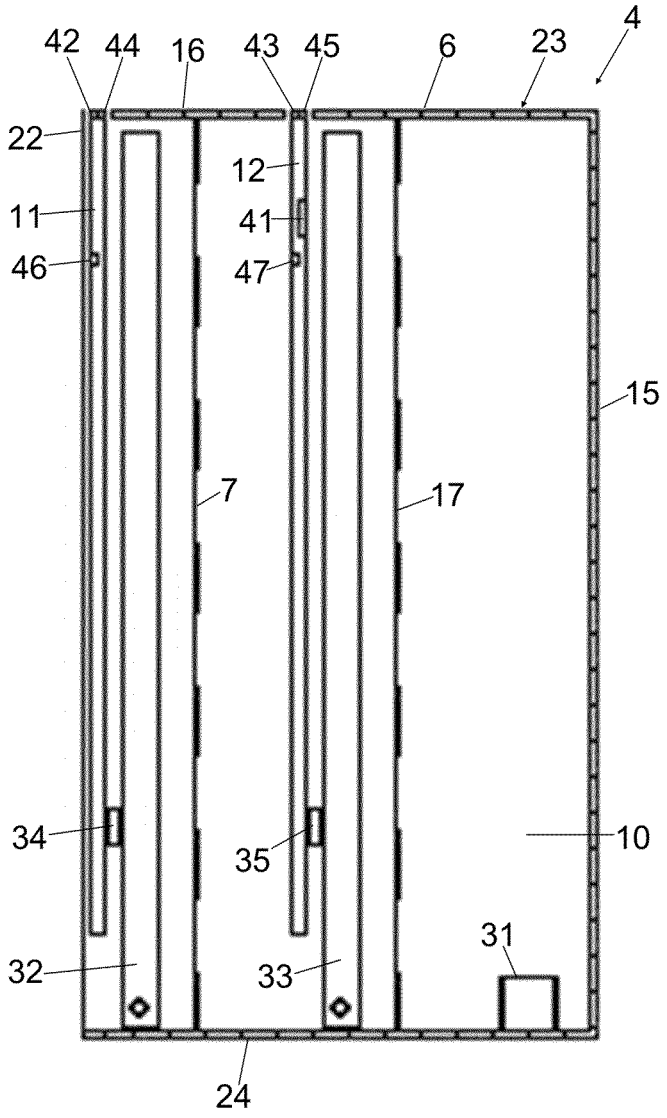

FIG. 1*e* shows a variant of an embodiment which is shown in FIG. 1*d*. FIG. 1*e* shows a cross section of a railway platform with two integrated protective walls 11, 12. The protective wall 11 forms the completion of the platform edge 22 or is positioned so close to the platform edge 22 of the platform 4 that during the lifting process of the protective wall 11, people who stand on the platform plateau 23 near to the platform edge 22 cannot fall into the track area. The protective wall 11 directly adjacent to the platform edge 22 is called the outer protective wall 11. The second the protective wall 12 with a greater distance to the platform edge 22 is called the inner protective wall 12. The greater the distance between the inner protective wall 12 and the outer protective wall 11, respectively the platform edge 22, the better the air pressure, created by a passing rail vehicle, can be reduced. According to FIG. 1*e* the outer protective wall 11 is connected with a drive cylinder 13. The drive cylinder 13 is used for moving the outer protective wall 11 from a retracted position to an extended position. As shown in FIG. 1*e* the drive cylinder may be a multistage drive cylinder. The outer protective wall 11 may be connected by a carriage with a linear vertical drive, which is shown in FIG. 2*a*. The linear vertical drive is used for moving the outer protective wall 11 from a retracted position to an extended position. In the extended position, the outer protective wall 11 is in the extended state, which can also be called a protection state. In the retracted position, the outer protective wall 11 is in the retracted state. In the retracted state the outer protective wall 11 may be overcome by the passengers without difficulties because it doesn't overlap or overtops only a very little the surface which forms the platform 4. The inner protective wall 12 is connected with a multistage drive cylinder 14. The drive cylinder 14 is used for moving the inner protective wall 12 from a retracted position to an extended position. The inner protective wall 12 may be connected by a carriage with the linear vertical drive, which is shown in FIG. 2*a*. In the extended position, the inner protective wall 12 is in the extended state, which can also be called a protection state. In the retracted position and the inner protective wall is in the retracted state. In the retracted state of the inner protective wall 12 may be overcome by the passengers without difficulties because it doesn't overtop the surface which forms the platform 4.

Figure 1F:
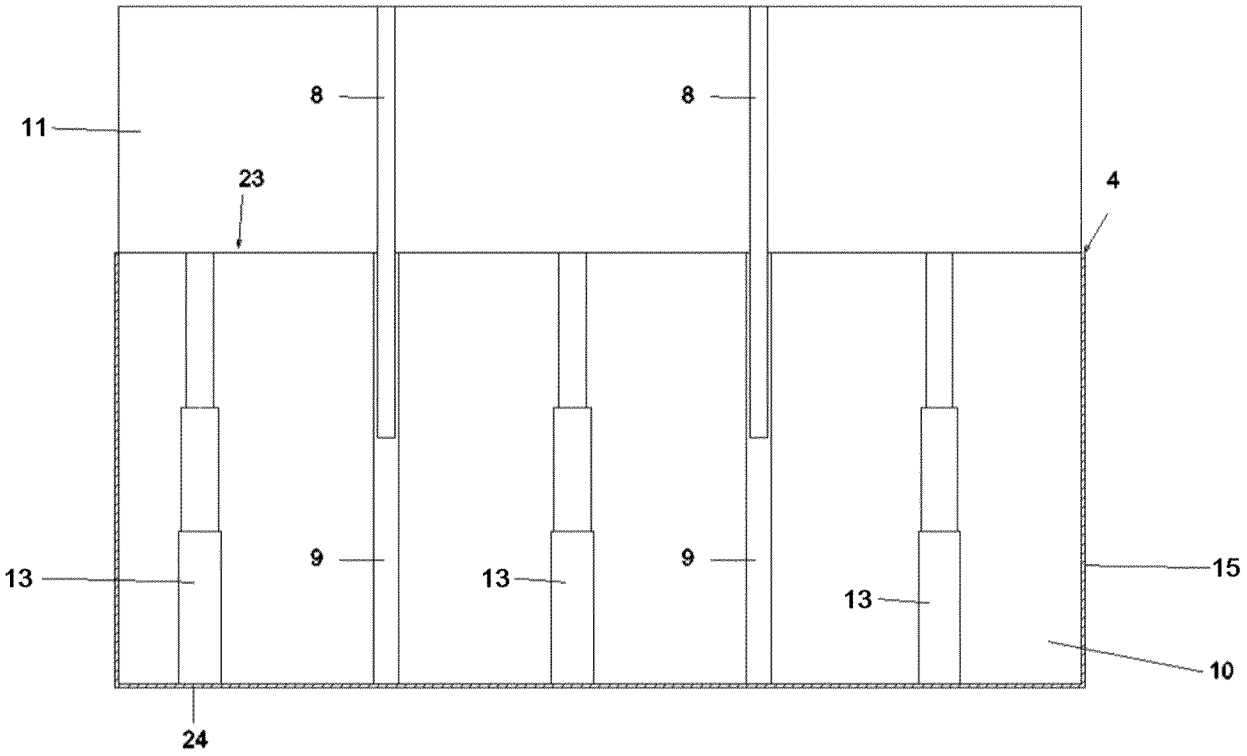

The protective walls 11, 12 and the drive cylinders 13, 14 are shielded by a shell 15. The protective walls 11, 12 in the retracted state and the driving device is covered by the shell 15 in a cage like manner. The shell 15 is limited on the track side by a border wall which forms the platform edge 22. The bottom of the shell 15 forms its floor 24. The shell 15 is delimited by the foundation of the platform 4 on the platform side. The upper side of the shell 15 is formed at least partially by the removable plates 6, 16 which are walkable. On the upper side, that means on the level of the platform plateau, a plate 6 which can swing upwardly is installed between the inner protective wall 12 and the rear wall of the shell 15. The plate 6 which can swing upwardly is usually closed and can only be opened by authorized specialists. On the upper side a plate 16 which can swing upwardly is installed between the outer protective wall 11 and the inner protective wall 12. The plate 16 which can swing upwardly is supported by pillars 7, which are fixed on the floor of the shell 15. The plate 16 which can swing upwardly is usually closed and can only be opened by authorized specialists. A reception element 9, for example a tube, is used as a reception for a pole 8 and can be used as a duct for the pole 8. The reception element forms a vertical guidance. Two such reception elements are shown in FIG. 1*f*. The pole 8 is connected with the protective wall 11, 12 and is used to stabilize the shape of the protective wall and/or for the stiffening of the protective wall 11, 12. By the use of one or several such poles 8, the stability of the protective wall against bulges, buckling or other types of deformation can be increased.

At the top of the outer protective wall 11 a sensing element 42, for example a pressure sensor may be installed which can stop, if required, the upward movement of the outer protective wall 11 according to FIG. 1*e*. At the top of the inner protective wall 12 a sensing element 43, for example a pressure sensor may be installed which can stop, if required, the upward movement of the inner protective wall 12. Instead of pressure sensors, light barriers, active infrared detectors or other types of sensors may be used. At the top of the outer protective wall 11 a warning element 44, for example a warning light, may be installed which indicates the passengers upward or downward movement of the outer protective wall 11. On the track-oriented side of the outer protective wall 11 a triggering element 46, for example a push button may be installed to trigger an emergency layering of the outer protective wall 11 for the case that after the lifting process of the outer protective wall 11 a person is situated for any reasons on the track-oriented side of the outer protective wall 11. On the track-oriented side of the inner protective wall 12 a triggering element 47, for example a push button, may be installed to trigger an emergency lowering of the inner protective wall 12 for the case that after the lifting process of the inner protective wall 12 a person is situated for any reasons on the track-oriented side of the inner protective wall 12. On the platform-oriented side of the inner protective wall 12 an indicating element 41 may be installed, for example a screen for passenger information like the next train run, the seat load factor in the concerning sector etc.

Between the drive cylinder 14 and the rear wall of the shell 15 a cavity 10 is located, to perform maintenance activities and in case of failure repair work. The cavity 10 is part of the shell 15 and is shaped as a walkable free space. The cavity may be dispensed with, if maintenance and repair work can be done only by switching the plate 16 upwardly. A control element 31, for example a remote control box controls the drive cylinders 13, 14 and in this way the vertical movements of the outer protective wall 11 and the inner protective wall 12. The control element 31 may be connected with an interlocking and can be managed by interlocking.

In the embodiments described as following, analogous parts are provided with the same reference signs so that a detailed description of these parts is not necessary.

FIG. 2*a* shows a cross-section of a platform with two integrated protective walls 11, 12. The protective wall 11 forms the completion of the platform edge 22 or is positioned so close to the platform edge 22 of the platform 4, such that during the lifting process of the protective wall 11, people who stand on the platform plateau 23 near to the platform edge 22 cannot fall into the track area. The protective wall 11 directly adjacent to the platform edge 22 is called the outer protective wall 11. The second protective wall 12 with a greater distance to the platform edge 22 is called the inner protective wall 12. The greater the distance between the inner protective wall 12 and the outer protective wall 11, respectively the platform edge 22, the better the air pressure, created by a passing rail vehicle, can be reduced. The outer protective wall 11 is connected by a carriage 34 with a linear vertical drive 32. The linear vertical drive 32 is used for the movement of the outer protective wall 11 from a retracted position to an extended position. In the extended position the outer protective wall 11 is in the extended state, which can also be called a protection state. In the retracted position, the outer protective wall 11 is in the retracted state.

In the retracted state, the outer protective wall 11 may be overcome by the passengers without difficulties because it doesn't overlap or overtops only very little the surface which forms the platform 4. The inner protective wall 12 is connected by a carriage 35 with a linear vertical drive 33. The linear vertical drive 33 is used for the movement of the inner protective wall 12 from a retracted position to an extended position. In the extended position the inner protective wall 12 is in the extended state, which can also be called a protection state. In the retracted position, the inner protective wall 12 is in the retracted state. In the retracted state the inner protective wall 12 may be overcome by the passengers without difficulty is because it doesn't overtop the surface which forms the platform 4.

An electrically driven linear vertical drive acts for example as a driving device for vertical movement. Such a driving device may for example comprise a linear module with a ball rail system or a roller guide with a ball screw drive or a toothed belt drive. Also other guides and drive systems are possible.

The protective walls 11, 12 and the linear vertical drives 32, 33 are shielded by a shell 15. The protective walls 11, 12 in the retracted state and the driving devices are covered by the shell 15 in the cage like manner. The shell 15 may be delimited on the track side by a border wall which forms the platform edge 22. Optionally the retracted protective wall 11 may also function as the track-sided border wall in each of the embodiments. The bottom of the shell 15 forms its floor 24. The shell 15 is delimited on the platform side by the foundation of the platform 4. The upper side of the shell 15 comprises at least partially the removable plates 6, 16 which are walkable. On the upper side, that means on the level of the platform plateau a plate 6 which can swing upwardly is installed between the inner protective wall 12 and the rear wall of the shell 15. The plate 6 which can swing upwardly is supported by pillars 17, which are fixed on the floor 24 or on the rear wall of the shell 15. The plate 6, which can swing upwardly is usually closed and can only be opened by authorized specialists. On the upper side a plate 16 which can swing upwardly is installed between the outer protective wall 11 and inner protective wall 12. The plate 16 which can swing upwardly is supported by pillars 7, which are fixed on the floor 24 of the shell 15. The plate 16 which can swing upwardly is usually closed and can only be opened by authorized specialists. A reception element 9, for example a tube is used as a reception for a pole 8 and can be used as a duct for the pole 8. The reception element forms a vertical guidance. Two such reception elements are shown in FIG. 1*f*. The pole 8 is connected with the protective wall 11, 12 and is used to stabilize the shape of the protective wall and/or for stiffening of the protective wall 11, 12. By making use of one or several such poles 8 the stability of the protective wall against bulges, buckling or other types of deformation can be increased.

At the top of the outer protective wall 11 a sensing element, for example a pressure sensor, maybe installed which can stop, if required, the upward movement of the outer protective wall 11. At the top of the inner protective wall 12 a sensing element 43, for example a pressure sensor, may be installed which can stop, if required, the upward movement of the inner protective wall 12. Instead of pressure sensors, light barriers, active infrared detectors or other types of sensors may be used. At the top of the outer protective wall 11, a warning element 44, for example a warning light, may be installed which indicates to the passengers the upward or downward movement of the outer protective wall 11. At the top of the inner protective wall 12 a warning element 45, for example a warning light, may be installed which indicates to the passengers the upward or downward movement of the inner protective wall 12. On the track-oriented side of the outer protective wall 11 a triggering element 46, for example a push button, maybe installed to trigger an emergency lowering of the outer protective wall 11 for the case that after the lifting process of the outer protective wall 11 a person is situated for any reasons on the track-oriented side of the outer protective wall 11. On the track-oriented side of the inner protective wall 12 a triggering element 47, for example a push button, maybe installed to trigger an emergency lowering of the inner protective wall 12 for the case that after the lifting process of the inner protective wall 12 a person is situated for any reasons on the track-oriented side of the inner protective wall 12. On the platform-oriented side of the inner protective wall 12 an indicating element 41 may be installed, for example a screen for passenger information like the next train run, the seat load factor in the concerning sector etc.

Between the linear vertical drive 33 and the rail wall of the shell 15 a cavity 10 is located for performing maintenance activities and in case of failure repair work. The cavity is part of the shell 15 and is shaped as a walkable free space. The cavity may be dispensed with, if maintenance and repair work can be done only by switching the plate 16 upwardly.

A control element 31, for example a remote control box, controls the linear vertical drives 32, 33 and in this way the vertical movements of the outer protective wall 11 and the inner protective wall 12. The control element 31, for example the remote control box, may be connected with an interlocking and can be managed by the interlocking.

In the embodiments described as following, analogous parts are provided with the same reference signs so that a detailed description of the parts is not necessary.

Figure 2B:
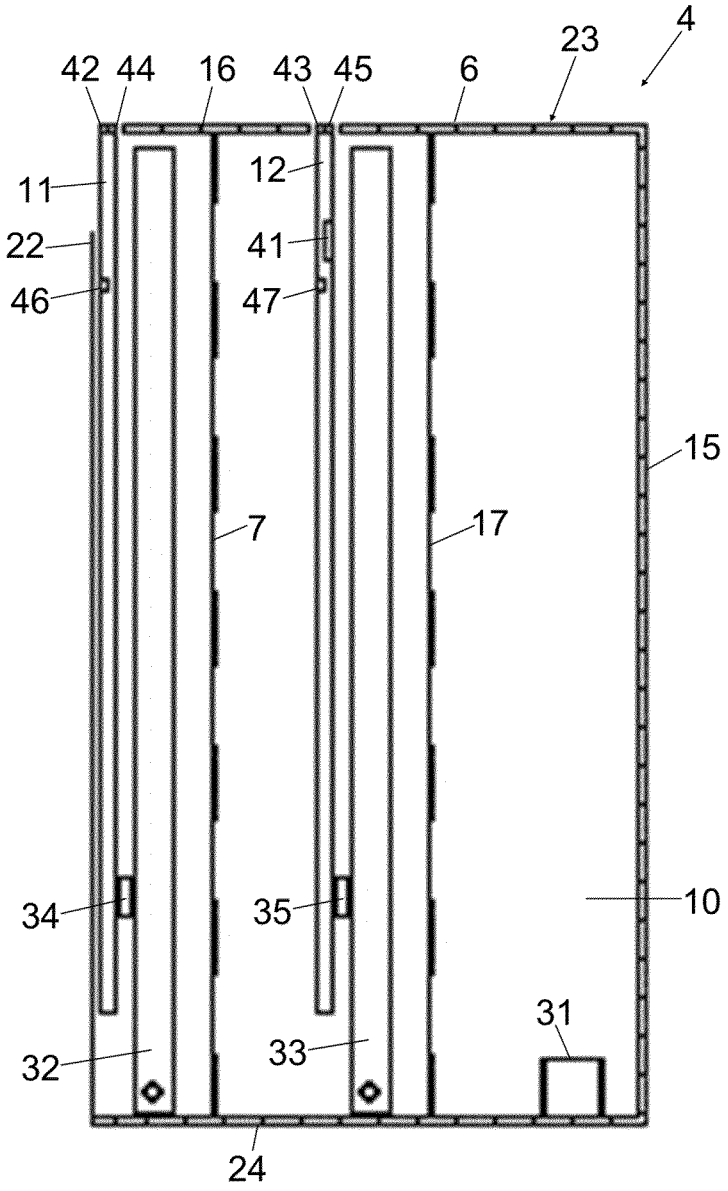

FIG. 2*b* shows the platform with the outer protective wall as the completion of the platform edge. In contrast to FIG. 2*a*, it's not the track-sided border wall 22 of the shell 15 in FIG. 2*b*, which forms the track-sided closure of the platform 4 on the level of the platform plateau but the outer protective wall 11 itself forms also in the retracted state at least partially the track-sided closure. For that reason, the track-sided border wall 22 of the shell 15 extends above the level of the track bed but doesn't extend as high as the outer protective wall 11 in the retracted state. The advantage is that in that way the distance between the wagon wall of the rail vehicle and of the outer protective wall 11 can be minimized also in the extended state.

FIG. 2*a* and FIG. 2*b* show the state while the rail vehicle stands still at the railway platform and the passenger exchange takes place. The outer protective wall 11 and the inner protective wall 12 are in the retracted state.

The FIGS. 2*c* to 2*l* serve therefore as an understanding of the chronological sequence and in this way the method of operation of the vertical movements of the outer protective wall 11 and the inner protective wall 12 after completion of the passenger exchange, during the passing through of rail vehicles without a scheduled stop at the platform 4 and before the complete standstill of rail vehicles with a scheduled stop at the platform 4.

Figure 2C:
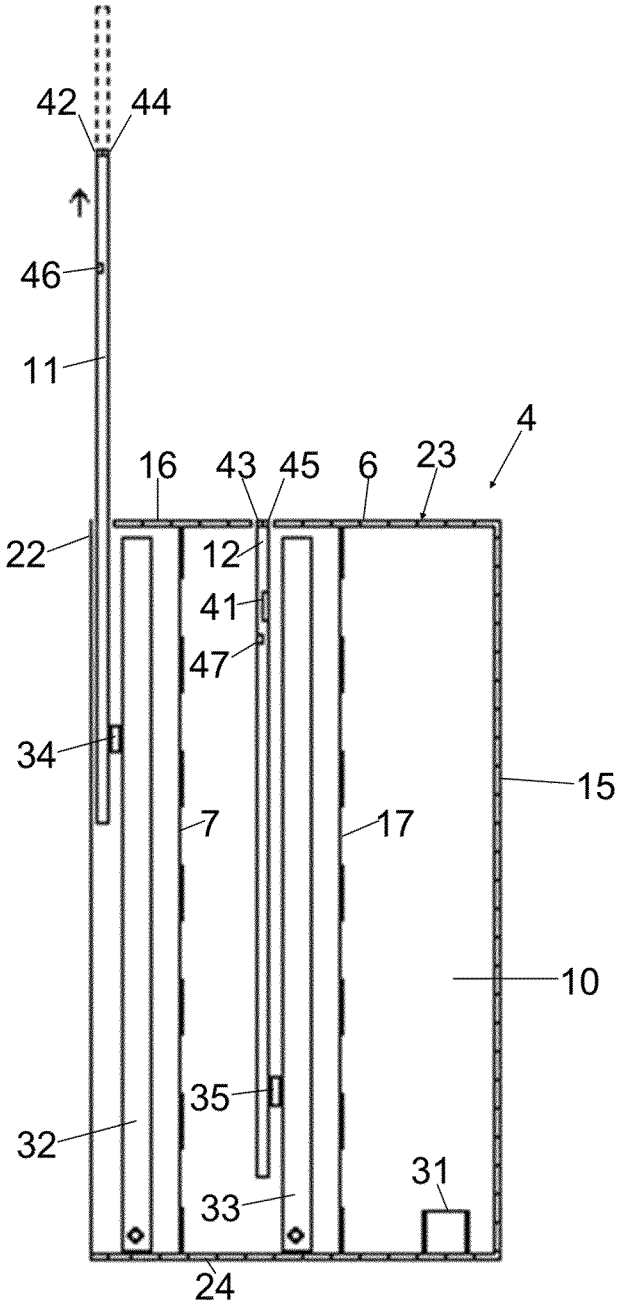

FIG. 2*c* shows the process after the completion of the passenger exchange. After completion of the passenger exchange the outer protective wall 11 gets lifted. As a consequence the track area and the platform area are mechanically separated. The time to start the lifting process of the outer protective wall 11 depends on the distance between the wagon wall of the rail vehicle and the outer protective wall 11 and it depends on the equipment of the rail vehicle. The following possible operational steps can be performed:

- The outer protective wall 11 only gets lifted after the rail vehicle completely left the track section beside the platform. This timing makes sense if the distance between the wagon wall of the rail vehicle and the outer protective wall 11 is so great that people could fall into this gap.
- The outer protective wall 11 gets lifted as soon as the rail vehicle started to move but has not already completely left the track section beside the platform. The lift timing makes sense if the distance between the wagon wall of the rail vehicle and the outer protective wall 11 is so great that people could fall into this gap or if the railway company doesn't accept an increase of the station dwell time of the rail vehicle. To avoid a too great air pressure between the wagon wall of the departing rail vehicle and the completely extended outer protective wall 11, it is advantageous that shortly after the departure of the rail vehicle the outer protective wall 11 gets lifted only to a fraction of its maximal extended state. And only after the rail vehicle has left the track section beside the platform completely, the outer protective wall gets lifted to its completely extended state.
- The outer protective wall 11 gets lifted after the passenger exchange while the rail vehicle stands still beside the platform. After the passenger exchange, the rail vehicle starts moving only after the outer protective wall 11 has got completely lifted or at least to a desired fraction of its maximal extended state. To avoid a too great air pressure between the wagon wall of the departing rail vehicle and the completely extended outer protective wall 11, it's advantageous that the outer protective wall 11 gets lifted only to a fraction of its maximal extended state as long as the rail vehicle stands still. After the rail vehicle has left completely the track section beside the platform, the outer protective wall gets lifted to its completely extended state. This timing makes sense if the railway company wants to reach with the installation of the protective wall system a level of safety similar to platform screen doors. In order that this application possibility brings the desired increase of safety, the following conditions have to be met:

The distance between the wagon wall of the rail vehicle and the outer protective wall 11 is sufficiently small so that no persons can be pinched in the gap between the rail vehicle and the platform.

The rail vehicle has a continuous smooth outer surface, also between the wagons. According to today's state of the art, only electric multiple units (EMU) with wagons not separable in commercial operation meet these requirements.

The rail vehicle is equipped with an automatic door closing system with crush protection and condition monitoring in the driver's cab comprising a vehicle immobilizer if the doors are opened.

The driver's cab of the rail vehicle is equipped with two buttons for the side selective door release control and a button for the enforced door closing with condition monitoring.

The rail vehicle is equipped with a transmitter and a receiver to control the vertical movement of the outer protective wall 11 and the inner protective wall 12.

The outer protective wall 11 and the inner protective wall 12 are equipped with a transmitter and a receiver to interact with the rail vehicle.

After the completion of the passenger exchange the train driver presses the button for the enforced door closing, the rail vehicle transmits the command to get lifted to the outer protective wall 11.

One option is that the outer protective wall 11 gets lifted as soon as the train driver presses the button for the enforced door closing, that means that the outer protective wall 11 gets lifted before all the doors are closed.

A second option is that the rail vehicle transmits the command to get lifted to the outer protective wall 11 only after all the doors are closed. This would increase the level of safety, but would prolong the station dwell time of the rail vehicle. After reaching the desired extended position, the outer protective wall 11 transmits a signal to the rail vehicle. When all the doors are closed, then the vehicle immobilizer in the driver's cab the rail vehicle is canceled and the rail vehicle can start to move. Instead of the vehicle immobilizer in the driver's cab of the rail vehicle, it is also possible to indicate the extended state of the outer protective wall 11 to the train driver by an additional signaling in the train driver's field of vision.

If the train driver wants to pick up more passengers after pressing the button for enforced door closing, he can press the door release button, so that the outer protective wall receives the command to be lowered and the departure process starts again.

Figure 2D:
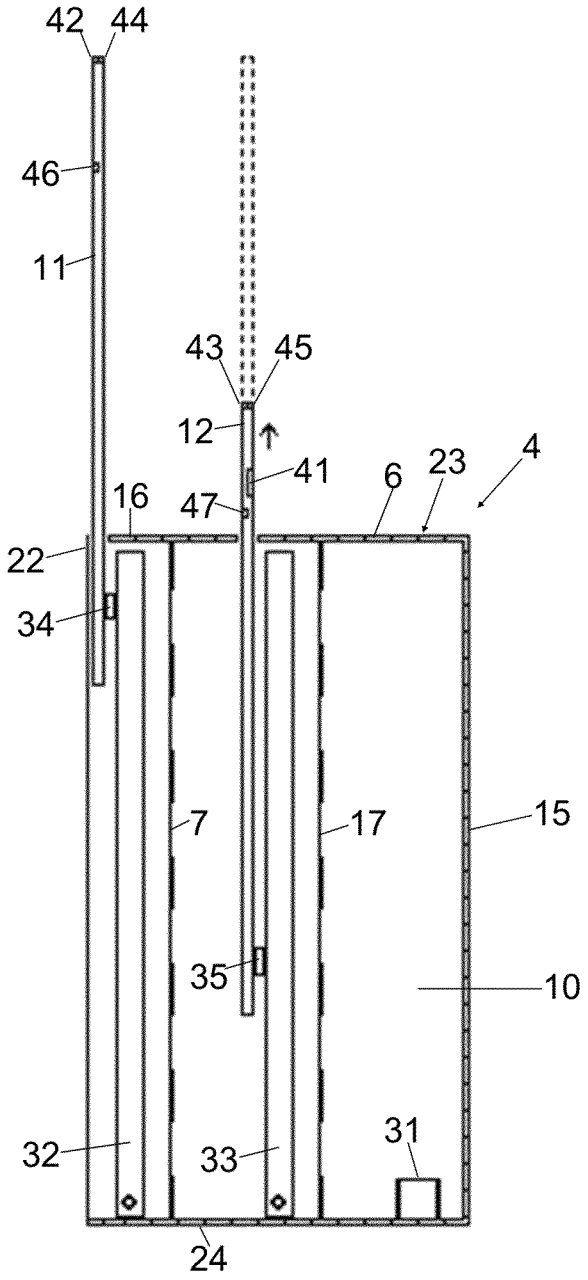

FIG. 2*d* shows the lifting process of the inner protective wall 12. If the outer protective wall 11 is in the extended state or lifted at a sufficiently high level that no person can fall anymore from the platform 4 into the track area also the inner protective wall 12 starts to get lifted. The advantage of a system with an outer protective wall 11 and an inner protective wall 12 compared to a system with only one protective wall as shown in WO2005/102808 A1 is that after the lifting process people can be on the wrong, track-oriented side of the inner protective wall 12. A prerequisite is, that the distance between the outer protective wall 11 and the inner protective wall 12 is not too large or the space between the protective walls 11, 12 is supervised. In particular during the lifting process people standing on the platform can be pushed safely to the platform-oriented side of the inner protective wall 12 by a mechanical solution presented in FIGS. 3*a*-3*d*, FIGS. 4*a*-4*c* and FIG. 6*a*.

Figure 2E:
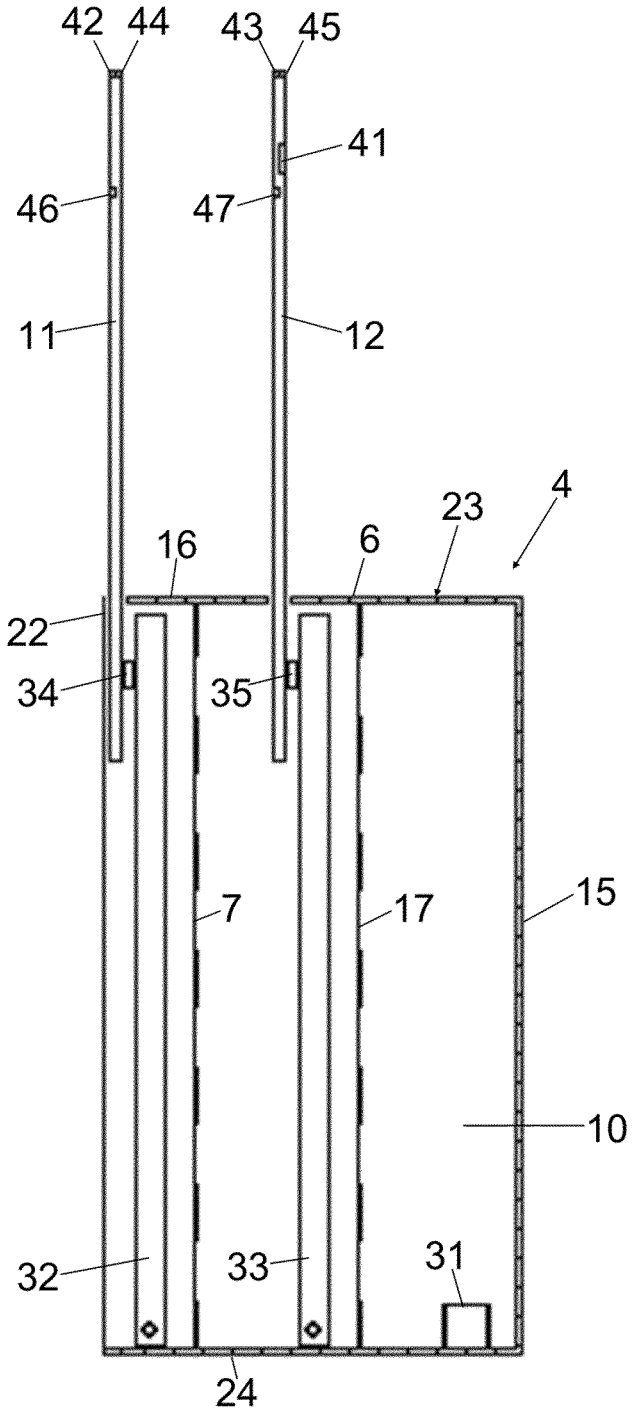
Figure 2F:
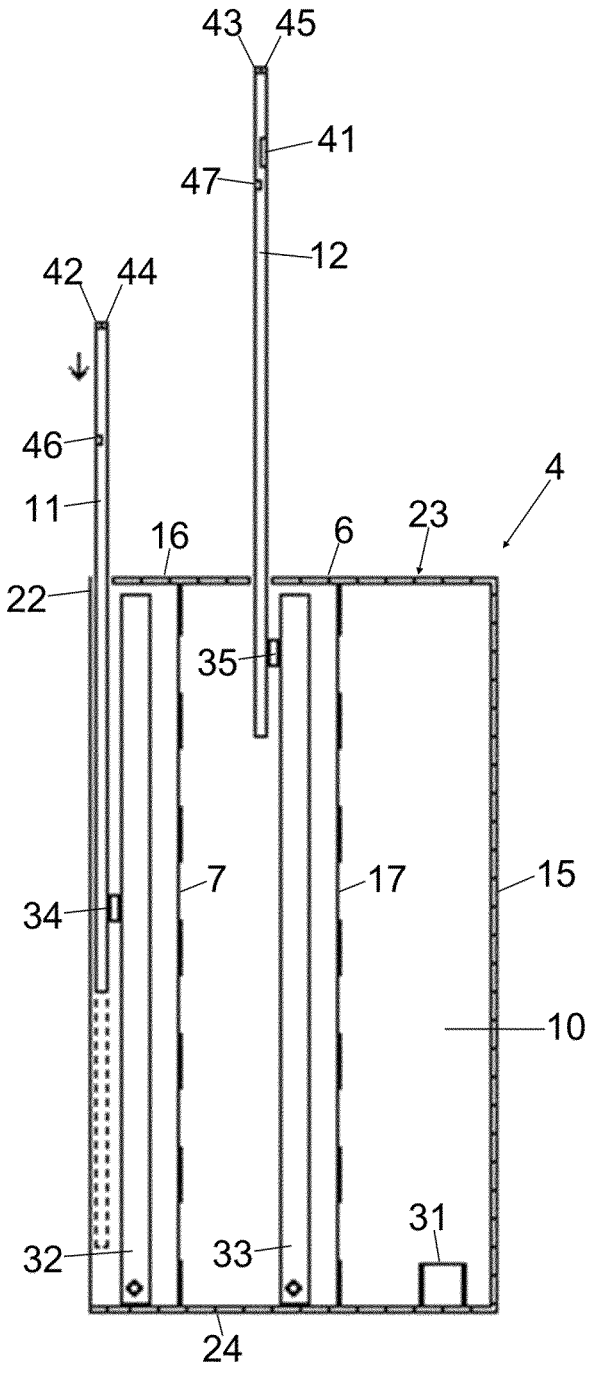
Figure 2G:
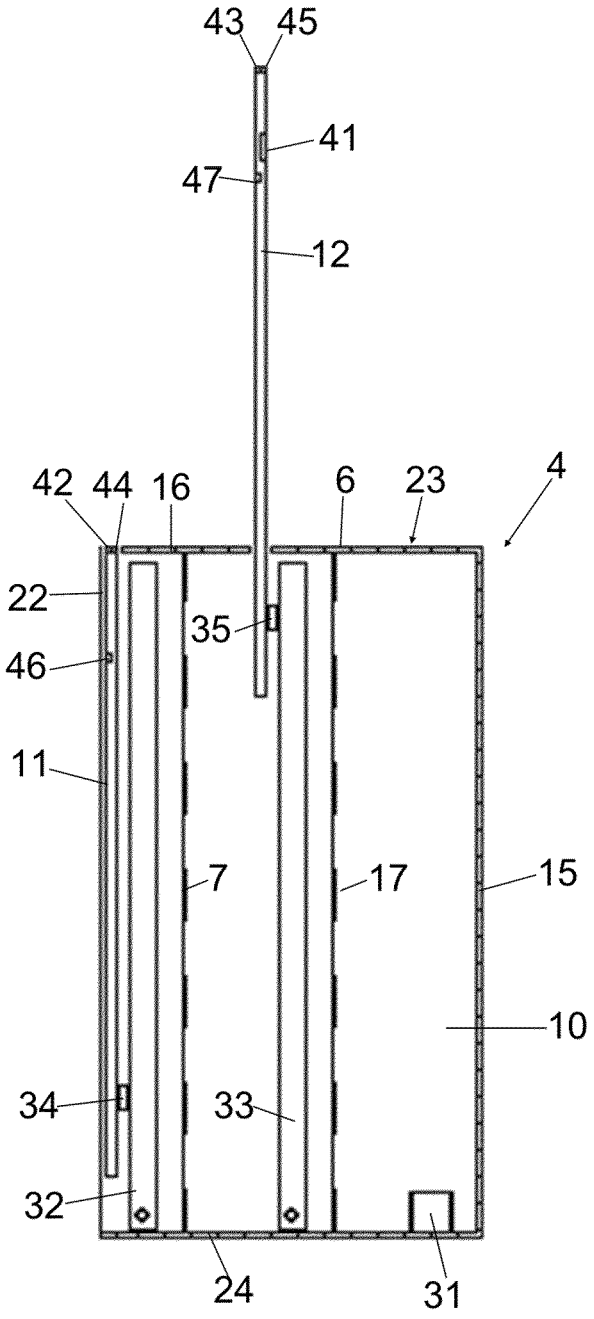

If both protective walls 11, 12 are in the extended state like it is shown in FIG. 2*e*, the outer protective wall 11 can be lowered like it is shown in FIG. 2*a*. Now only the inner protective wall 12 is in the extended state like it is shown in FIG. 2*g*. This is the state when the rail vehicles pass the platform without a scheduled stop. The advantage of this system compared to a system as described in JP1994957764U is that passing rail vehicles can pass at high speed. Between the inner protective wall 12 and the passing rail vehicle and upwardly open channel is formed by which the air compressed by the rail vehicle can escape and so a too high air pressure cannot accumulate.

Figure 2H:
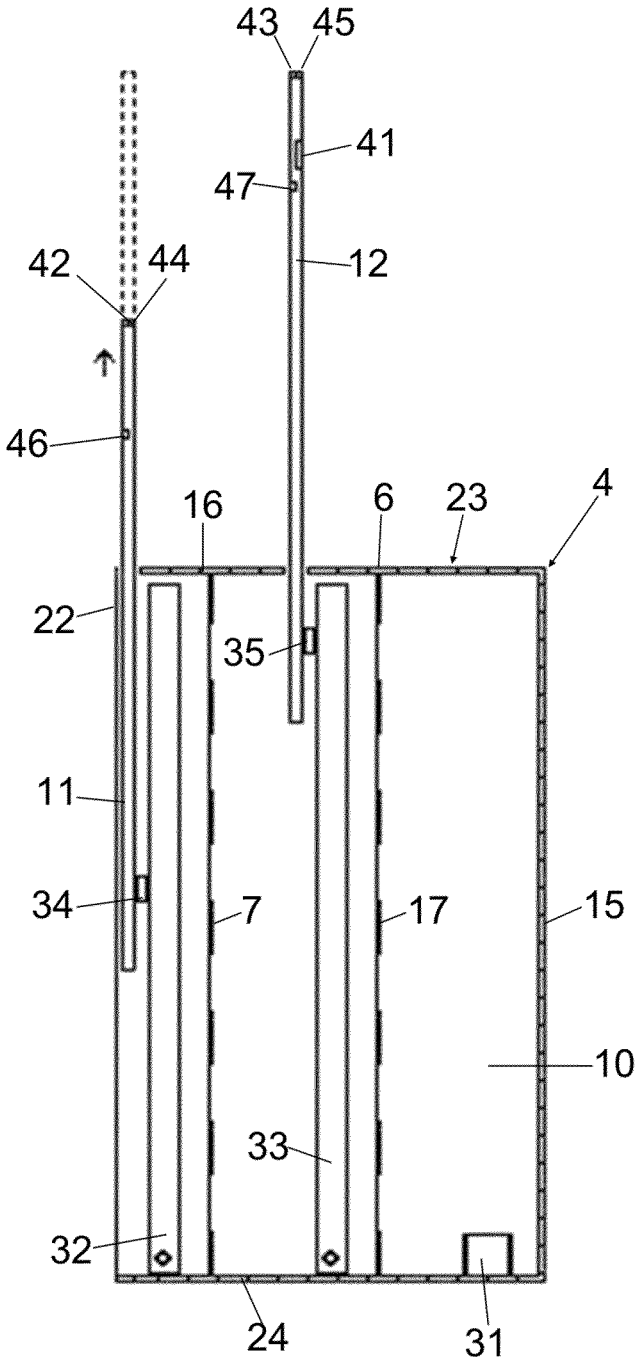

If the rail vehicle has left the track area beside the platform without a scheduled stop and the next rail vehicle will be rail vehicle with a scheduled stop and passenger exchange, so that the outer protective wall 11 can get lifted like it is shown in FIG. 2*h*. The outer protective wall 11 should get lifted to the extent that the air pressure between the wagon wall of the incoming rail vehicle and the outer protective wall 11 can't pose a risk. How high the outer protective wall 11 should get lifted depends on the maximum speed of the incoming the rail vehicle and on the distance between the wagon wall of the incoming rail vehicle and the outer protective wall 11. The speed of incoming rail vehicles with a scheduled stop and passenger exchange is usually lower than the speed of passing rail vehicles, nevertheless especially at the beginning of the platform the speed can still be significantly high, for that reason a completely extended outer protective wall 11 could cause a too high air pressure.

Figure 2I:
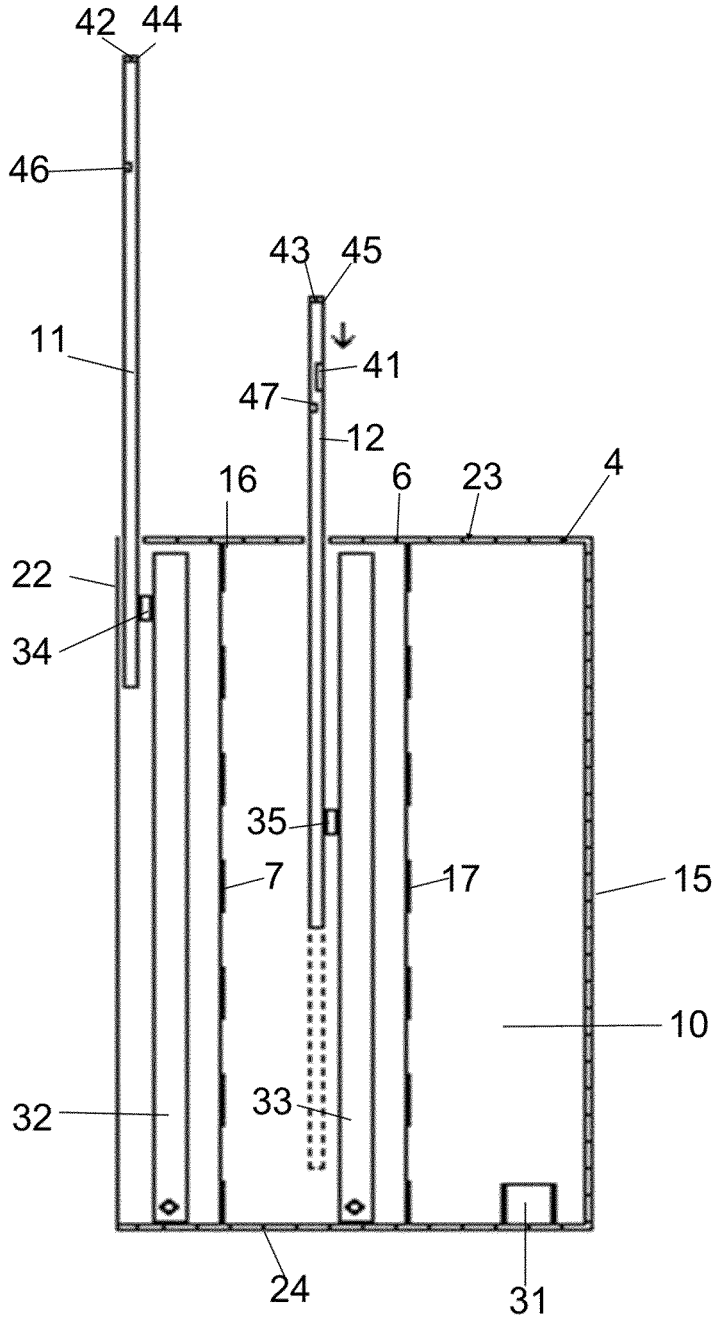
Figure 2J:
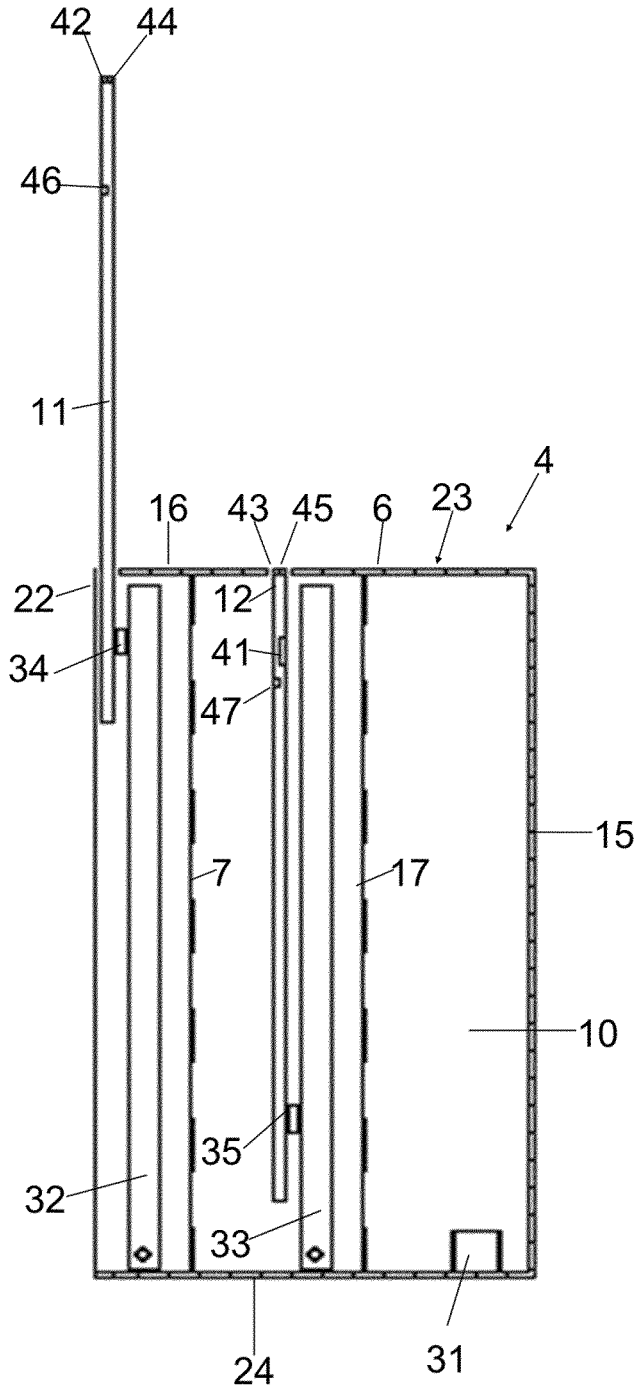

After the outer protective wall 11 has reached the desired extended state, the inner protective wall 12 can be lowered completely as shown in FIG. 2*i*. As shown in FIG. 2*j* the outer protective wall 11 is completely extended or extended to a desired fraction of its maximal extended state. At this point in time, the rail vehicle with a scheduled stop and passenger exchange can get the permission to enter the track section beside the platform.

A further option is that first the outer protective wall 11 gets lifted to its maximal extended state, afterwards the inner protective wall 12 is completely lowered and after that the outer protective wall 11 is lowered to a desired fraction of its maximal extended state.

Figure 2K:
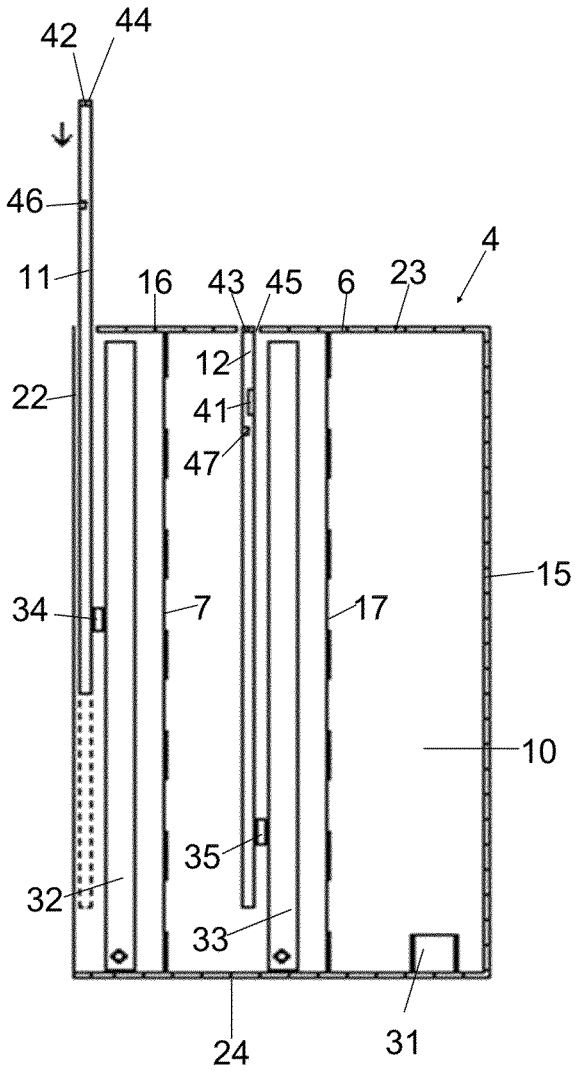
Figure 2L:
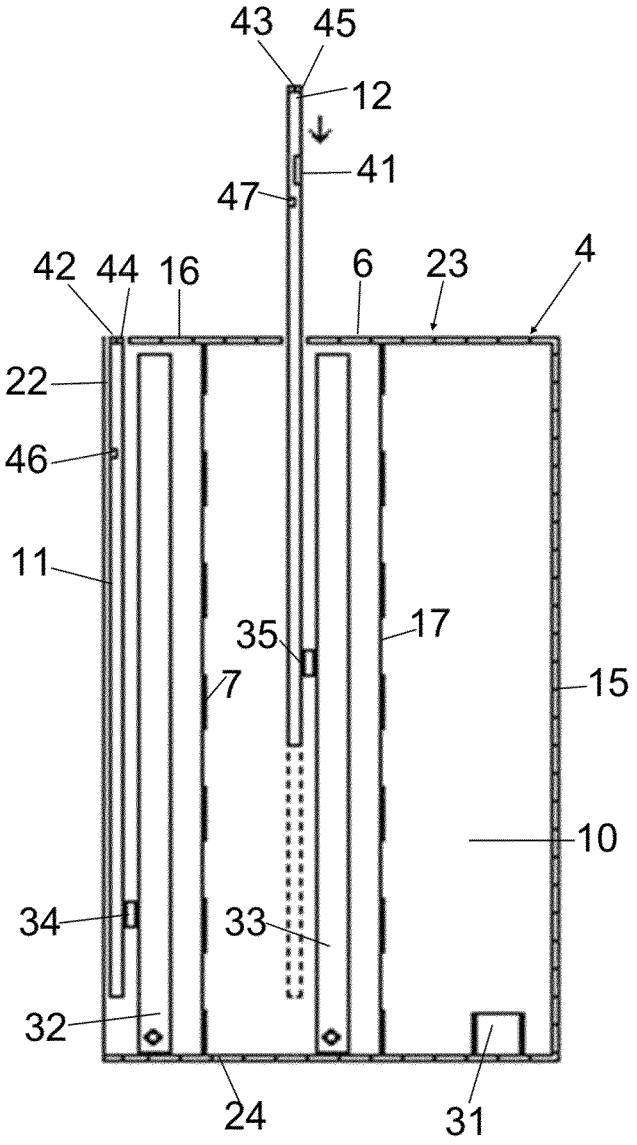

FIG. 2*k* shows how of the outer protective wall is completely lowered to allow a passenger exchange. There are the following possible timings:

The outer protective wall 11 is completely lowered before the rail vehicle with a scheduled stop and passenger exchange enters the track section beside the platform: this is the simplest possibility but poses the risk that people could fall in front of the incoming train.

The outer protective wall 11 is completely lowered only shortly before the stop of the rail vehicle. The outer protective wall 11 receives the command to be lowered by the following options:

In the track pressure sensors are installed. As soon as the rail vehicle has passed a defined track section the command to be lowered is transmitted to the outer protective wall.

The rail vehicle transmits the command to be lowered to the outer protective wall as soon as the rail vehicle slowed down below a defined velocity, for example 20 km/h.

The outer protective wall is equipped with sensors. As soon as the rail vehicle has passed a defined track section or slowed down below a defined velocity, the command to be lowered is transmitted.

The rail vehicle transmits the command to be lowered to the protective wall as soon as the train driver presses the door release button.

The outer protective wall 11 should be in the retracted state before the rail vehicle stands still. As soon as the outer protective wall 11 is completely lowered, it transmits a signal to the rail vehicle. If the outer protective wall 11 is completely lowered, that means the outer protective wall 11 is in the retracted state, and the rail vehicle stands still, the doors may be opened.

Before the entry of a rail vehicle with a scheduled stop and passenger exchange, instead of a method of operation as described in FIGS. 2*h*-2*k* it would also be possible to lower the inner protective wall 12 to the retracted state directly to prevent the lifting-up and the lowering of the outer protective wall 11. This option is shown in FIG. 21. However, the direct lowering of the inner protective wall 12 has the disadvantage that shortly before the inner protective wall 12 reaches its retracted position, it can be tripping hazard for the passengers waiting on the platform. For safety reasons the method of operation described in FIGS. 2*h*-2*k* is preferable.

Figure 2M:
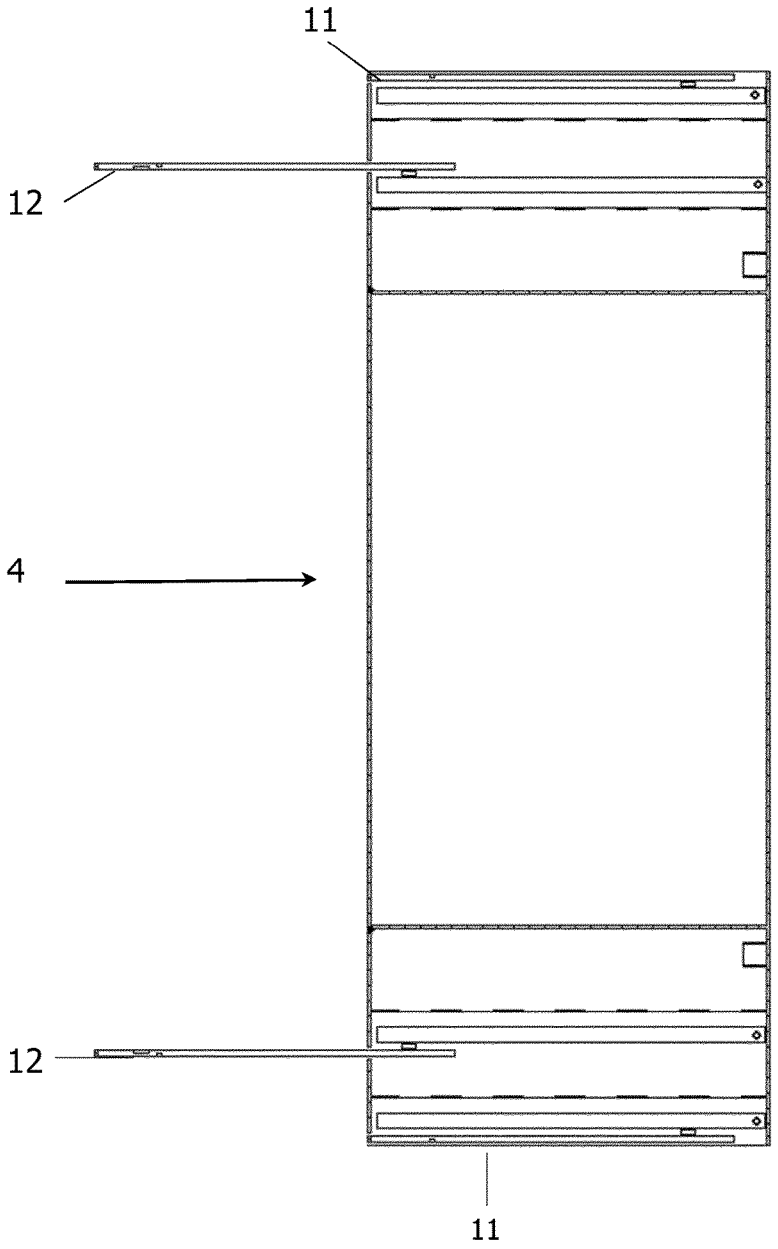

FIG. 2*m* shows a cross section of a central platform 4 with two integrated protective walls 11, 12 on both sides. The tracks are arranged on the left and on the right hand side the central platform. The two protective wall systems on the left and right hand side work independently of one another. The mode of operation of the protective walls 11, 12 is the same as described in FIGS. 2*a*-2*i*.

In the embodiment according to FIGS. 3*a*-3*d*, the protection device described in FIGS. 2*a*-2*m* is additionally equipped with a mechanical system 51 between the outer protective wall 11 and the inner protective wall 12 to push people standing on the platform safely to the platform-oriented side of the inner protective wall 12 during the lifting process of the inner protective wall 12. Instead of a removable plate 16 on the level of the platform plateau 23, the mechanical system 51 may be arranged between the outer protective wall 11 and the inner protective wall 12, the mechanical system 51 may be constructed as an extendable intermediate element. The extendable intermediate element 51 is supported by pillars 7. During the lifting and lowering process the extendable intermediate element 51 is guided along vertically aligned guidances in the outer protective wall 11 and along vertically aligned guidances in the inner protective wall 12. In this way the mechanical system 51 seals the space between the outer protective wall 11 and the inner protective wall 12.

Figure 3A:
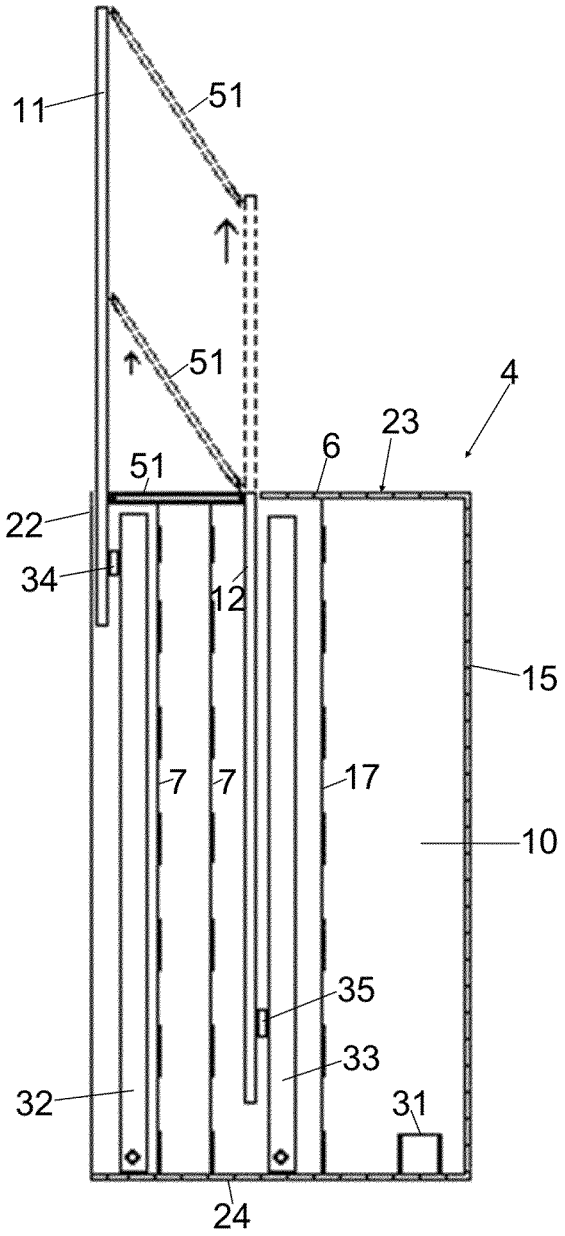
Figure 3B:
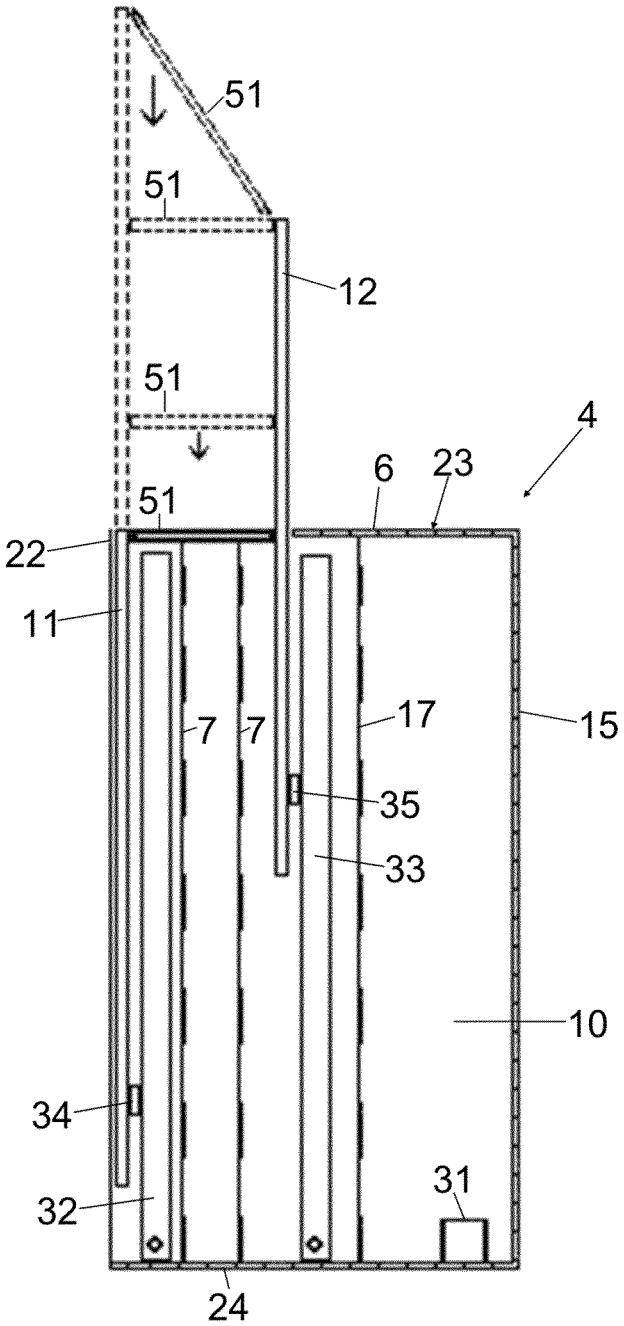
Figure 3C:
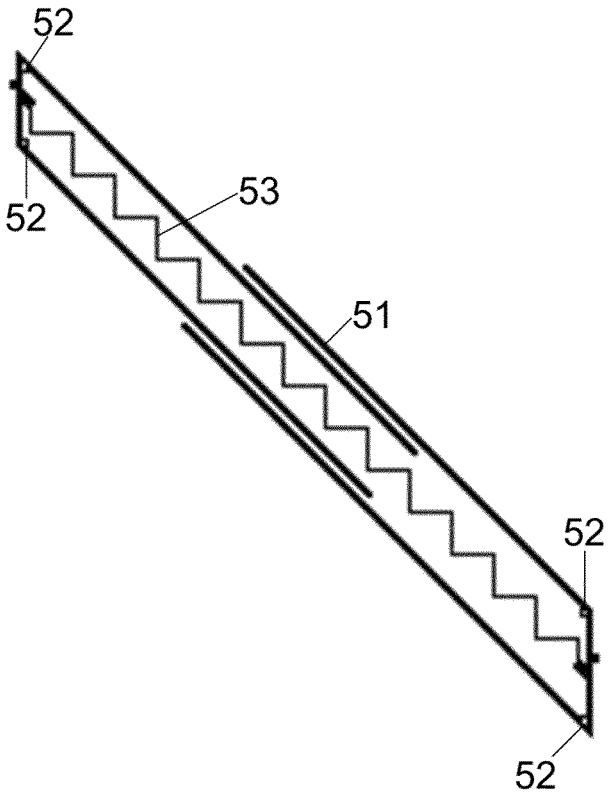
Figure 3C:
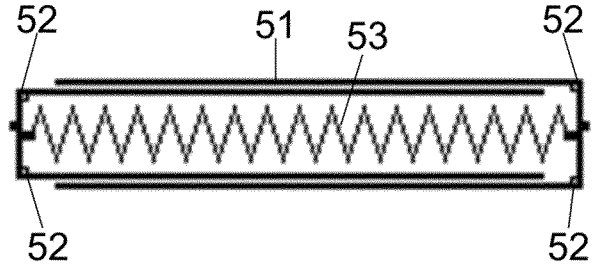

FIG. 3*c* shows the construction of the extendable intermediate element 51 in the stretched state and in the contracted state. The extendable intermediate element 51 consists of a frame, a spring element 53 inside and hinges 52 in the outer corners.

Figure 3D:
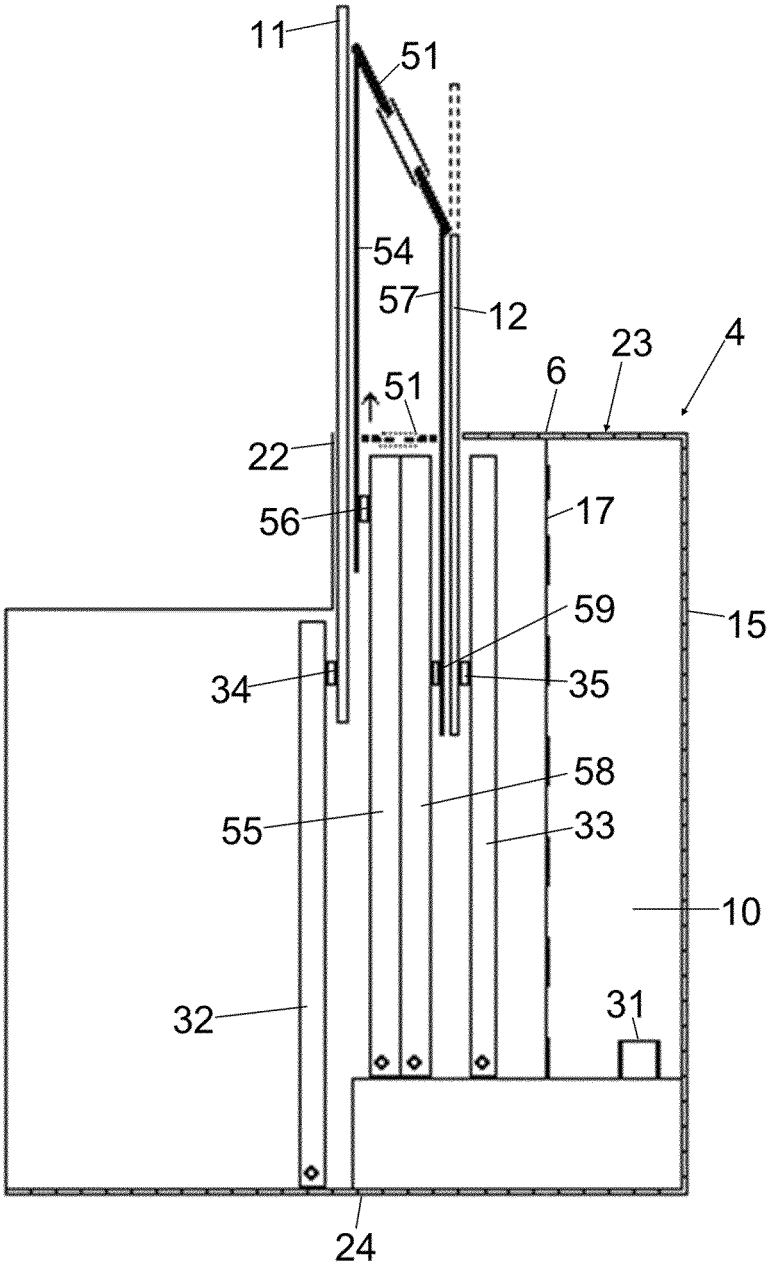

The frame consists of at least two frame components which are mutually insertable and which form also in the stretched state a continuous robust outer shell. Each of the frame components may be configured as a whole body which includes a part of the spring element 53. In particular the hollow body may have a circular profile or a rectangular profile. Each of the frame components has an open end and a closed end. At the closed end, an ending of the spring element is connected with the frame component. The closed end also forms the outer corners where the hinge 52 is attached, it makes contact with a protective wall or a driving device which is activatable by the movement of the protective wall. The cross sectional area of the two frame components is different so that one frame component can be put over the other frame component. In this way, the two frame components are mutually insertable at their open ends. The extension of the extendable intermediate element 51 increases by an upwardly directed force onto the track-oriented frame component. The upwardly directed force to the track-oriented frame component can be transmitted by a carriage with a drive arranged in the guidance of the outer protective wall 11 as shown in FIG. 3*a*, or alternatively, as shown in FIG. 3*d*, the track-oriented frame component is pushed upwardly by a pole 54 with its own linear vertical drive 55. The increased extension of the extendable intermediate element 51 is necessary that the extendable intermediate element 51 gets the desired inclination during the lifting process to push people standing on the platform safely to the platform-oriented side of the inner protective wall 12. By means of the hinges 52, the extendable intermediate element 51 may glide along the guidances despite the changed inclination. A spring 53 is arranged inside the extendable intermediate element 51, which contracts the two frame components slightly and helps in this way that after completion of the lifting process, the extendable intermediate element 51 returns to its original horizontal alignment.

In the embodiment according to FIGS. 3*a*, 3*b* inside the guidance in the outer protective wall 11 is a carriage with its own drive to move upwards the track-oriented frame component of the extendable intermediate element 51. The chronological sequence of the vertical movements of the outer protective wall 11, the extendable intermediate element 51 and the inner protective wall 12 in the embodiment according to FIG. 3*a*, 3*b* is as follows:

After the completion of the passenger exchange, the outer protective wall 11 gets lifted. During the lifting process of the outer protective wall 11 the extendable intermediate element 51 stays on the level of the platform plateau 23. To avoid that at this moment the track-oriented frame component of the extendable intermediate element 51 gets lifted together with the outer protective wall 11, the carriage in the guidance of the outer protective wall 11 decouples itself and remains on the level of the platform plateau 23. If the outer protective wall 11 is in the extended state or lifted at a sufficient altitude level, that no person situated on the platform 4 could fall anymore into the track area, the carriage by means of its own drive in the guidance of the outer protective wall 11 lifts the track-oriented frame component of the extendable intermediate element 51 to an altitude level at which the extendable intermediate element 51 reaches the desired inclination. The platform-oriented frame component of the extendable intermediate element 51 remains blocked on the level of the platform plateau 23 by an end portion of the guidance at the upper edge of the inner protective wall 12. The inclination of the extendable intermediate element 51 has to be sufficiently steep, so that in the further process people standing on the platform are pushed safely to the platform-oriented side of the inner protective wall 12. In the further process, as shown in FIG. 3*a*, the inner protective wall 12 as well as the carriage with its own drive in the guidance in the outer protective wall 11 move upwardly together with the same speed, so that the inclination of the extendable intermediate element remains constant. The end portion of the guidance at the upper edge of the inner protective active wall 12 prevents the extendable intermediate element 51 from moving upwards faster than the inner protective wall 12, whereby a gap between the extendable intermediate element 51 and the inner protective wall 12 is made impossible during the lifting process. The carriage with its own drive in the guidance in the outer protective wall 11 moves upwardly towards the end portion of the guidance at the upper edge of the outer protective wall 11 and is blocked in this position. At this moment the inner protective wall has been lifted at a sufficiently high level to separate the platform area safely from the track area. Also after the extendable intermediate element 51 has reached its maximum height, the inner protective wall 12 can continue to get lifted. After the inner protective wall 12 has reached the extended state, the outer protective wall 11 and the extendable intermediate element 51 can be lowered to the level of the platform plateau 23. The easiest way is that the carriage in the guidance in the outer protective wall 11 remains blocked at the upper edge of the outer protective wall 11 and in this way the extendable intermediate element 51 is lowered to the level of the platform plateau together with the outer protective wall 11 by the linear vertical drive 32. As the carriage in the guidance in the outer protective wall is blocked at the upper edge of the outer protective wall, in the retracted state the upper edge of the outer protective wall 11 and extendable intermediate element 51 represent a plane, which becomes subsequently important during the passenger exchange. If the outer protective wall 11 and the extendable intermediate element 51 are lowered to the level of the platform plateau, the rail vehicles can now pass the platform at high speed. If the last rail vehicle has left the track area of the platform without a scheduled stop and the next rail vehicle will be a rail vehicle with a scheduled stop at the platform, the outer protective wall 11 can get lifted as shown in FIG. 2*h*. At this moment, no persons have to be pushed away, for this reason the extendable intermediate element 51 remains at the level of the platform plateau. The carriage in the guidance in of the outer protective wall decouples itself and remains on the level of the platform plateau to avoid that the extendable intermediate element 51 gets lifted together with the outer protective wall 11. After the inner protective wall 12 has been lowered to the retracted state as shown in FIG. 2*i*, outer protective wall 11 is lowered into the retracted state before the passenger exchange.

A further embodiment comprises a toothed rack in the guidance in the outer protective wall 11 and a gear wheel with an electric motor on the track-oriented side of the extendable intermediate element 51. The gear wheel with electric motor is a part of the track-oriented frame component of the extendable intermediate element 51. The energy supply for the electric motor is provided by an electric cable which is lead to the electric motor through a hole in the track-oriented frame component of the extendable intermediate element 51.

In the embodiment according to FIG. 3*d* the lifting and lowering process as well as the inclining process of the extendable intermediate element 51 is performed by poles 54, 57 at the outer end portion of the frame components of the extendable intermediate element 51 whereby each of the poles are connected by a carriage 56, 59 with an own linear vertical drive 55, 58. The extendable intermediate element 51 has its own driving mechanism for the vertical movements consisting of the pole 54, the vertical drive 55, the carriage 56, the pole 57, vertical drive 58 and the carriage 59, for that reason it is possible to dispense with a drive in the guidance in the outer protective wall 11. Thereby the design of the outer protective wall 11 is simplified, which increases the reliability of the system. Ideally, the linear vertical drive 32 of the outer protective wall 11 and the linear vertical drive 55 of the pole 54 of the track-oriented frame component of the extendable intermediate element 51 are arranged offset to one another inside a shell 15 as shown in FIG. 1*a*.

Alternatively, the linear vertical drive 32 of the outer protective wall 11 can be arranged below the track bed as shown in FIG. 3*d*. However, the renovation of existing railway platforms for the installation of a protective wall system would become more complex.

The chronological sequence of the vertical movements of the outer protective wall 11 of the extendable intermediate element 51 and of the inner protective wall 12 is as follows:

After completion of the passenger exchange, the outer protective wall gets lifted. If the outer protective wall 11 in the extended state is lifted sufficiently high that persons can't fall from the platform 4 into the track area anymore, the linear vertical drive 55 lifts the pole 54 and the track-oriented frame component of the extendable intermediate element 51 gets lifted to an altitude allowing a sufficiently steep inclination of the extendable intermediate element 51 to push people standing on the platform in the further process safely to the platform-oriented side of the inner protective wall 12. If the extendable intermediate element 51 has a sufficiently steep inclination, also the linear vertical drive 58 starts to lift the pole 57 and thus the platform-oriented frame component of the extendable intermediate element 51 gets lifted, and also the linear vertical drive 33 starts to lift the inner protective wall 12. The track-oriented frame component of the extendable intermediate element 51, the platform-oriented frame component of the extendable intermediate element 51 and the inner protective wall 12 move upwardly with the same speed, whereby the inclination of the extendable intermediate element 51 remains constant. By means of the end portion of the guidance at the upper edge of the inner protective wall 12, the extendable intermediate element 51 can move upwardly faster than the inner protective wall 12, whereby a gap between the extendable intermediate element 51 and the inner protective wall 12 is made impossible during the lifting process. If the inner protective wall 12 has reached the extended state, the outer protective wall 11 and the extendable intermediate element 51 can be lowered to the level of the platform plateau. From this very moment, the rail vehicles can pass the platform at high speed. If the last rail vehicle without scheduled stop has left the track area beside the platform and the next rail vehicle will be a rail vehicle with a scheduled stop at the platform and a passenger exchange, the outer protective wall 11 can get lifted as shown in FIG. 2*h*. At this moment, no persons have to be pushed away, for this reason the extendable intermediate element 51 remains at the level of the platform plateau. After the inner protective wall 12 is lowered to the retracted state, as a shown in FIG. 2*i*, also the outer protective wall 11 is lowered into the retracted state before the passenger exchange.

A further embodiment comprises an own drive 55, 58 for the extendable intermediate element 51 as shown in FIG. 3*d*, but no guidances in the outer and inner protective wall. Thereby, the extendable intermediate element 51 has no direct contact with the outer protective wall 11 or the inner protective wall 12. It has to be ensured that during the lifting process of the extendable intermediate element 51 no gap may arise between the extendable intermediate element 51 and the inner protective wall 12.

Figure 4A:
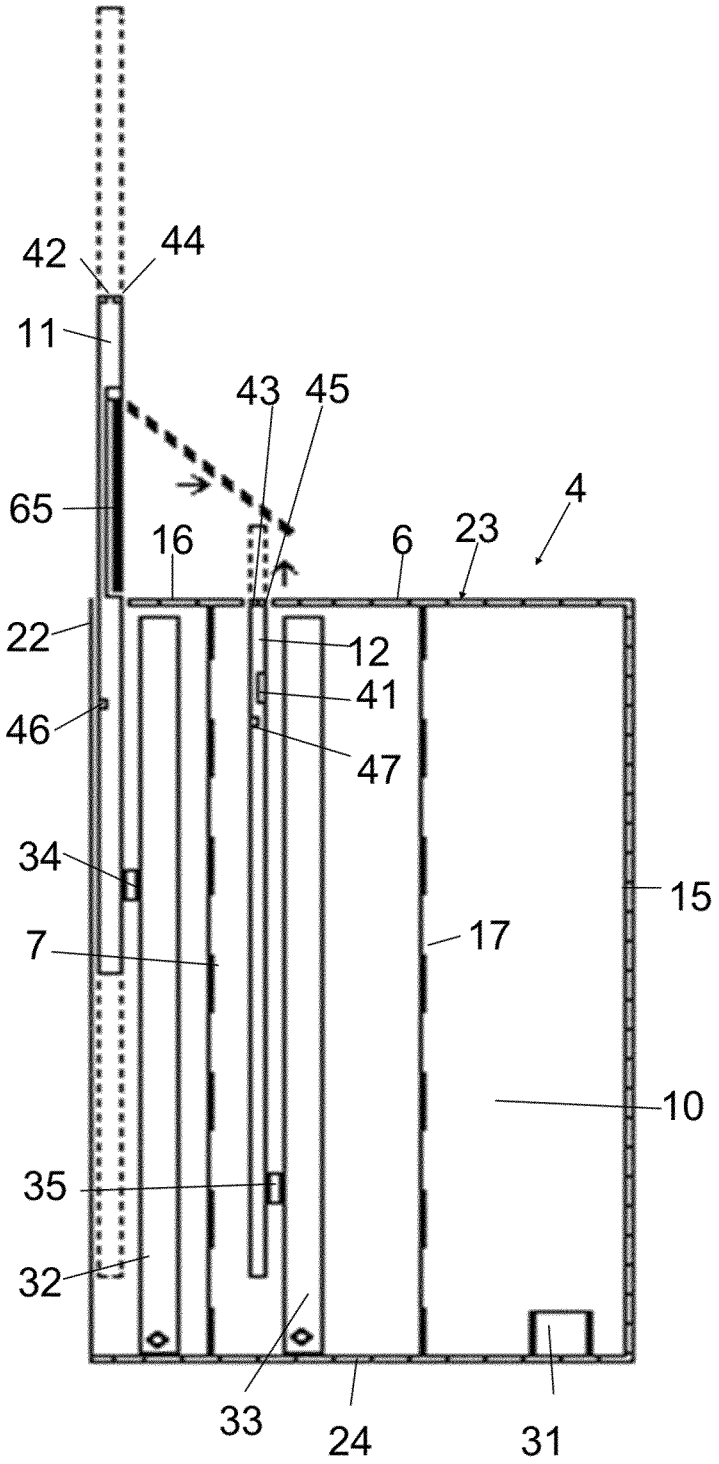
Figure 4B:
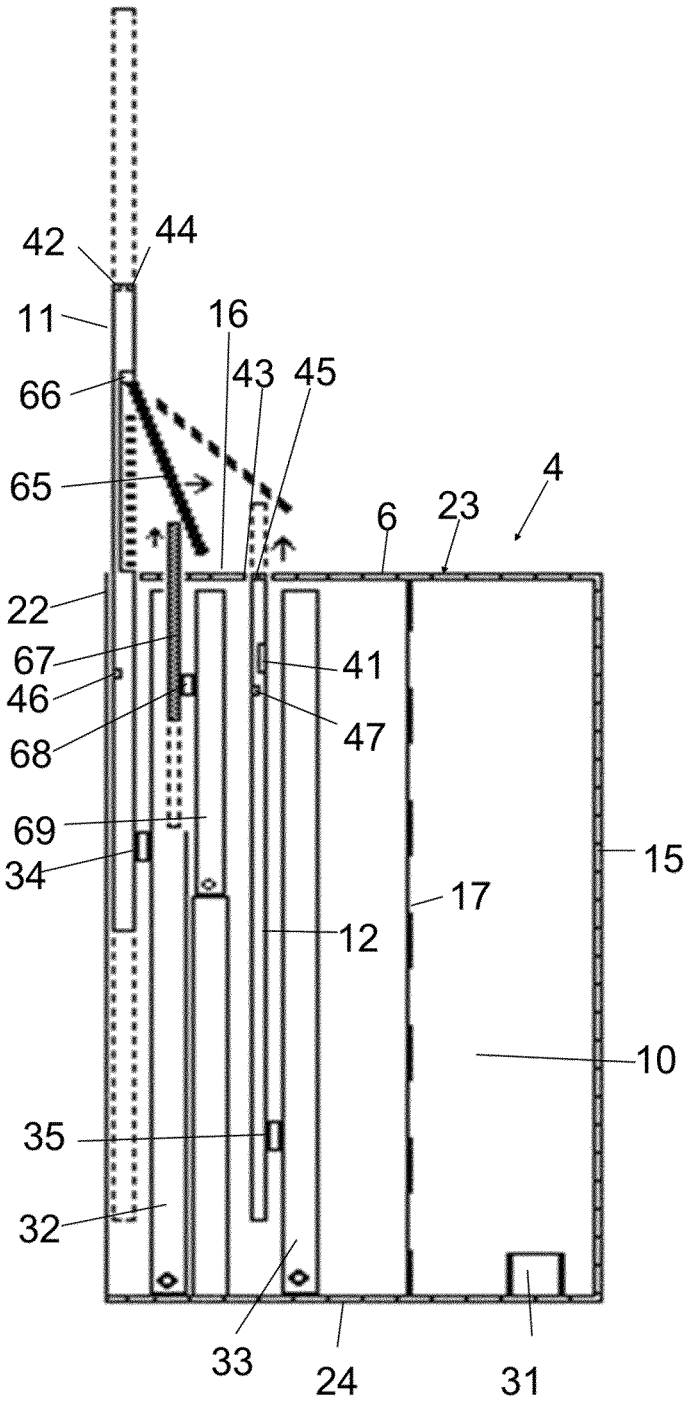
Figure 4C:
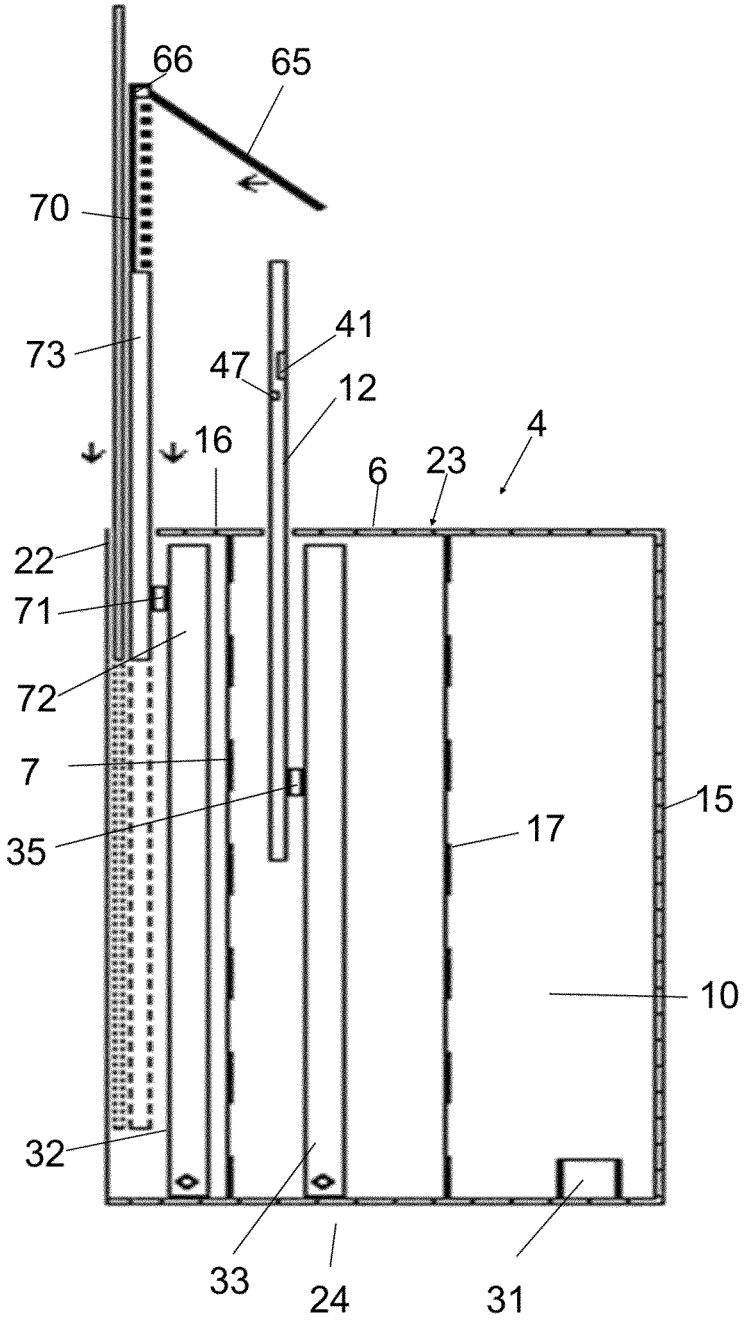

In the embodiments according to FIGS. 4*a*-4*c*, the protection device described in FIGS. 2*a*-2*m* is additionally equipped with a hinged flap 65 to push people standing on the platform 4 safely to the platform-oriented side of the inner protective wall 12 during the lifting process of the inner protective wall 12. The hinged flap 65 can be integrated into the outer protective wall 11 or be fixed on a separate support element 70. By a sensor or a fixation to the rear wall of the outer protective wall 11 or a fixation to the rear wall of the separate support element 70 it is ensured, that the outer protective wall 11 or the separate support element 70 only may be lowered if the hinged flap 65 is in the pulled-back state.

The advantage of the system with a hinged flap 65 compared to a system as described in FIG. 3*a*-3*d* is that the flap can have a very steep inclination during the lifting process of the inner protective wall 12. A further advantage of the flap concerns the hygienic aspect. According to the system described in FIGS. 3*a*-3*d*, the extendable intermediate element 51 in the retracted ground state is soiled by the passenger's shoe soles. The hinged flap 65 has in its ground state no contact with the passengers. A further advantage of a flap is the possibility that the inner protective wall 12, instead of being a continuous wall, may also consist of poles standing close together. Similar to a fork, the poles could be aggregated by a bar, so that a linear vertical drive 33 could move many poles at the same time. Poles standing close together would also have the advantage that it is harder for children to climb them.

In the embodiment according to FIGS. 4*a*, 4*b* the hinged flap 65 is integrated into the outer protective wall 11. The length of the hinged flap 65 is at least equal to the distance between the outer protective wall 11 and the inner protective wall 12, so that the space between the outer protective wall 11 and the inner protective wall 12 can be covered in the inclined pushed-out state. The design of the hinged flap 65 can also be much longer and overtop the inner protective wall 12 during the lifting process of the inner protective wall 12. The push-out movement of the hinged flap can be caused by:

- A drive 66 at the mounting of the hinged flap 65 on the outer protective wall 11 at the upper end of the hinged flap 65.
- A rotatable horizontal pole at the mounting of the upper end of the hinged flap 65, whereby the rotatable horizontal pole is connected to a drive below the hinged flap 65.
- A spring element at the rear wall behind him flap 65 which pushes the hinged flap upwards, whereby the pulling-back may be done through a rope which is mounted on the flap and is led by a wheel at the rear wall to a rope winch below the outer protective wall 11.

Also other drive forms for the push-out and pull-back movement of the flap 65 are possible. In the embodiment according to FIG. 4*b* the push-out process of the flap is additionally supported by a retractable bollard or by an auxiliary pole 67 which is connected by a carriage 68 with the linear vertical drive 69. The auxiliary pole and the retractable bollard move in the vertical direction. As soon as the hinged flap is pushed out a little by a drive, the auxiliary pole supports the following push-out process until its completion.

The chronological sequence of the vertical movements of the outer protective wall 11, the push-out and pull-back movements of the hinged flap 65 and the vertical movements of the inner protective wall 12 in the embodiment according to FIGS. 4*a*, 4*b* are as follows:

After completion of the passenger exchange, the outer protective wall 11 gets lifted by the linear vertical drive 32. If the outer protective wall 11 is lifted sufficiently high so that the hinged flap 65 is situated completely above the level of the platform plateau 23, the upward movement of the outer protective wall 11 stops and the hinged flap 65 starts to be pushed out. People standing on the platform are pushed to the platform-oriented side of the inner protective wall 12 by the push-out movement of the flap 65.

During the push-out process of the hinged flap 65 a small gap between the lower end of the hinged flap 65 and the platform plateau 23 opens. The greater the distance between the outer protective wall 11 and the inner protective wall 12 and the flatter the inclination of the hinged flap 65 in the pushed-out state, the greater the gap will be between the hinged flap 65 in the pushed-out state and the platform plateau 23. To minimize this gap, the length of the hinged flap 65 has to be adapted to the distance between the outer protective wall 11 and the inner protective wall 12. The greater the distance between the outer protective wall 11 and the inner protective wall 12, the greater should also be the length of the hinged flap. If the railway company wants to close this gap completely, the design of the hinged flap 65 could also contain an extendable element, thereby the hinged flap 65 could enlarge its extension during the push-out process.

If the hinged flap 65 is in the pushed-out state, the linear vertical drive 33 starts to lift the inner protective wall 12. In the further process the outer protective wall 11, the hinged flap 65 and the inner protective wall 12 move upwardly with the same speed. If the inner protective wall 12 is lifted sufficiently high to separate the track area from the platform area safely, the linear vertical drive 33 stops the upward movement of the inner protective wall 12. The outer protective wall 11 and the hinged flap 65 continue to move upwards a little, until the hinged flap can be pulled back. The hinged flap 65 will be completely pulled back and the outer protective wall 11 can be lowered to the retracted state. At this moment, rail vehicles can pass through the station at high speed. If the last rail vehicle has left the track area without a scheduled stop beside the platform and next rail vehicle will be a rail vehicle with a scheduled stop at the platform and passenger exchange, the outer protective wall 11 can get lifted as shown in FIG. 2*h*. At this moment, no persons have to be pushed away, for this reason the hinged flap 65 remains in the pulled-back state. After the inner protective wall 12 is lowered to the retracted state as shown in FIG. 2*i*, also the outer protective wall 11 will be lowered to the retracted state before the passenger exchange.

In the embodiment according to FIG. 4*c* the hinged flap 65 is installed on a separate support element 70. For its vertical movement the support element 70 is connected with its own linear vertical drive 72 by a vertical pole 73 and the carriage 71. The support element 70 has in the region of the hinged flap 65 a continuous rear wall. Below the region of the flap, there are cavities between the poles 73 which are connected to the linear vertical drives 72. This cavity is necessary to ensure that a space for the linear vertical drives 32 of the outer protective wall 11 remains. The linear vertical drives 32 of the outer protective wall 11 and the linear vertical drives 72 of the support element 70 are arranged offset to one another.

The support element 70 can be guided along vertically aligned guidances on the platform-oriented side of the outer protective wall 11.

The length of the hinged flap 65 is at least equal to the distance between the outer protective wall 11 and the inner protective wall 12, so that the space between the outer protective wall 11 and the inner protective wall 12 can be covered in the inclined pushed-out state. The design of the hinged flap 65 can also be much longer and overtop the inner protective wall 12 during the lifting process of the inner protective wall 12.

The push-out movement of the hinged flap 65 can be caused by:

- A drive 66 at the mounting of the hinged flap 65 on the support element 70 at the upper end of the hinged flap 65.
- A rotatable horizontal pole at the mounting of the upper end of the hinged flap 65, whereby the rotatable horizontal pole is connected with a drive below the hinged flap 65.
- A spring element at the rear wall behind the hinged flap 65 which pushes the hinged flap 65 upwards, whereby pulling-back may be done through a rope which is mounted on the flap and is led by a wheel at the rear wall to a rope winch below the support element 70.

Also other drive forms for the push-out and pull-back movement of the flap 65 are possible.

To install the hinged flap 65 on a separate support element 70 has various advantages, compared to the embodiment described in FIGS. 4*a*, 4*b:*

- The design of the outer protective wall is simpler and the outer protective wall 11 can be thinner, thus the outer protective wall 11 has a lower thickness then in the previous embodiments.
- The vertical extension of the outer protective wall 11 can be smaller.
- An increase of safety, because the outer protective wall 11 is already completely in the extended state during the lifting process of the hinged flap 65.
- Because the outer protective wall 11 is already in the extended state before the support element 70 and the hinged flap 65 get lifted, the design of the support element 70 can be thicker than that of an outer protective wall 11 with an integrated hinged flap 65. This facilitates the installation of a drive for the push-out movement of the hinged flap 65.

A disadvantage of the embodiment according to FIG. 4*c* compared to the ones in FIGS. 4*a*, 4*b* is that the hinged flap 65 and the support element 70 in the retracted state restrict the vertical extension of the linear vertical drives. Because the hinged flap 65 is a continuous plate, the linear vertical drives 32 of the outer protective wall 11 can't reach below the plate 16 due to lack of space. The distance between the removable plate 16 and the upper end of the linear vertical drive 32 corresponds to the distance between the upper edge of the support element 70 and the lower end of the hinged flap 65.

The chronological sequence of the vertical movements of the outer protective wall 11, the supporting element 70 and the inner protective wall 12 as well as the push-out and pull-back movements of the hinged flap 65 in the embodiment according to FIG. 4*c* is as follows:

After completion of the passenger exchange, the outer protective wall 11 gets lifted. Is the outer protective wall 11 in the extended state or lifted so high that persons can't fall anymore from the platform into the track area, the linear vertical drive 72 starts to lift the support element 70 to a sufficient altitude, such that the hinged flap 65 is situated completely above the level of the platform plateau 23. If the hinged flap 65 is situated completely above the level of the platform plateau 23, the upward movement of the support element 70 stops and the hinged flap 65 starts to be pushed out. By the push-out movement of the hinged flap 65, people standing on the platform 4 are pushed safely to the platform-oriented side of the inner protective wall 12.

During the push-out process of the hinged flap 65 a small gap between the lower end of the hinged flap 65 and the platform plateau 23 opens. The greater the distance between the outer protective wall 11 and the inner protective wall 12 and the flatter the inclination of the hinged flap 65 in the pushed-out state, the greater the gap will be between the hinged flap 65 in the pushed-out state and the platform plateau 23. To minimize this gap, the length of the hinged flap 65 has to be adapted to the distance between the outer protective wall 11 and the inner protective wall 12. The greater the distance between the outer protective wall 11 and the inner protective wall 12, the greater should also be the length of the hinged flap. The embodiment according to FIG. 4*c* enables the possibility for a very steep inclination of the hinged flap 65 in the pushed-out state, overtops further the hinged flap 65 in the pushed-out state the inner protective wall 12, in this way the gap can be minimized. If the railway company wants to close this gap between the lower end of the hinged flap 65 in the pushed-out state and the platform plateau 23 completely, the design of the hinged flap 65 could also contain an extendable element, so that the hinged flap 65 could enlarge its extension during the push-out process.

If the hinged flap 65 is in the pushed-out state, the linear vertical drive 33 starts to lift the inner protective wall 12. In the further process the inner protective wall 12 and the support element 70 move upwardly with the same speed. If the inner protective wall 12 lifted at a sufficient level to separate the track area from the platform area, the linear vertical drive 33 stops the upward movement of the inner protective wall 12. The support element 70 continues to move upwardly a little, until the hinged flap 65 can be pulled back. The hinged flap 65 will be completely pulled back and the support element 70 can be lowered to the retracted state.

At this moment, rail vehicles can pass through the station at high speed. If the last rail vehicle has left the track area beside the platform without a scheduled stop and the next rail vehicle will be a rail vehicle with a scheduled stop at the platform and passenger exchange, the outer protective wall 11 can get lifted like it is shown in FIG. 2*h*. At this moment, no persons have to be pushed away, for this reason the support element 70 remains in the retracted state. After the inner protective wall 12 is lowered to the retracted state like shown in FIG. 2*i*, also the outer protective wall 11 will be lowered to the retracted state before the passenger exchange.

The embodiments according to FIGS. 5*a*-5*f* are alternatives to the protective wall systems depicted in FIGS. 1-4 in case of limited space is available underneath the platform plateau 23. If there is enough space available in the bottom beneath the platform plateau 23 to install a protective wall system as shown in FIGS. 1-4, it is more favorable to install one of those systems due to their simplicity in the design of the components. However, there can be areas along the platform, for example when there is a subway for pedestrians under the platform, where there is not enough space in the bottom underneath the platform plateau 23 for the installation of a linear vertical drive as shown in FIGS. 1-4. The protective wall systems in FIGS. 5*a*-5*f* have the advantage that they have a much smaller vertical extent in the retracted state.

Figure 5A:
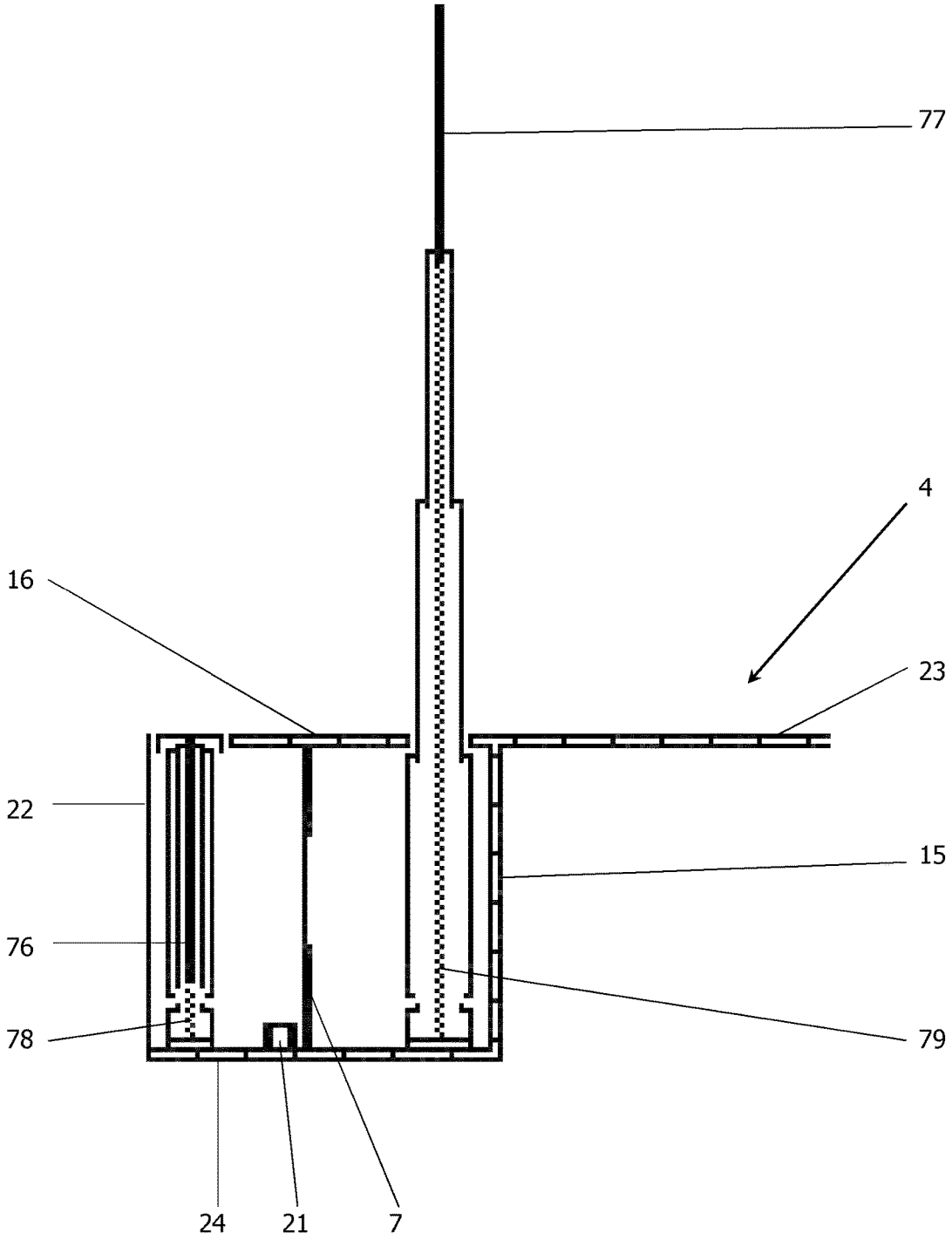

FIG. 5*a* presents the cross section of a platform with two integrated protective walls 76, 77 which are extendable in several parts. The outer protective wall 76 consists of multi-part extendable plates. The plates are ordered side by side in the retracted state and are stacked at a slight angle in the extended state. The side of the plates facing the passengers and closer to the platform have to be completely closed in the extended state. The plates can be hollow in the inside and open on the side facing the rail tracks. The motion of extension and retraction of the topmost plate in the extended state is supported with a driving mechanism 78. The driving mechanism is largely located inside the outer protective wall 76. A driving mechanism 78 can be a cross-cutter drive, a telescopic extendable cylinder or another driving system. If both sides of the outer protective wall 76 are covered with plates, there is the advantage of being protected against dust and dirt. If only the side of the wall 76 facing the platform is covered and the side facing the track is open, there is the advantage that repair work can be done easier.

The inner protective wall 77 also consists of multi-part extendable plates. In the retracted state the plates are arranged side by side, in the extended state, they are stacked at a slight angle. The plates have to form a complete closure in the extended state on the side closer to the platform and facing the passengers. The plates can be hollow on the inside and open on the side facing the rail tracks. The movement of extension and retraction of the topmost plate in the extended state is supported with a driving mechanism 79. The driving mechanism is largely located inside the inner protective wall 77. A driving mechanism 79 can be a cross-cutter drive, a telescopic extendable cylinder or another driving system. If both sides of the inner protective wall 77 are covered with plates, there is the advantage of being protected against dust and dirt. If only the side of the wall 77 facing the platform is covered and the side facing the track is open, there is the advantage that repair work can be done easier.

FIG. 5*a* shows the outer protective wall 76 in the retracted state and the inner protective wall 77 in the extended state, that means, the state in which rail vehicles pass through at a high speed along the platform. The chronological sequence of the upward- and downward movements of the outer protective wall 76 and the inner protective wall 77 after the completion of the passenger exchange, while rail vehicles pass without a scheduled stop at the platform 4 and before the complete standstill of rail vehicles with a scheduled stop at the platform 4 are the same like in the embodiment shown in FIGS. 2*a*-2*m*.

Figure 5B:
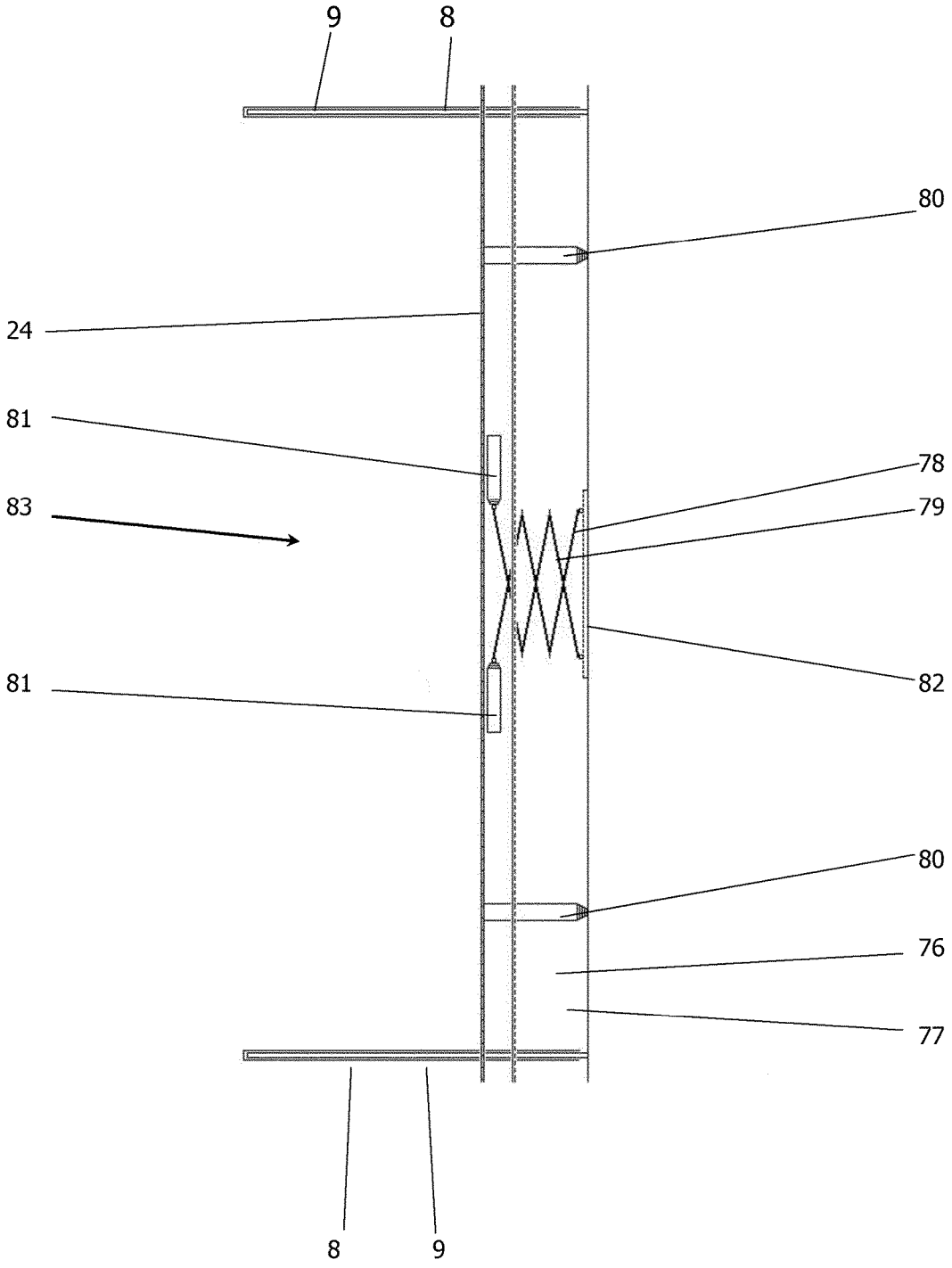

FIG. 5*b* presents the cross section of the embodiment of a multi-part extendable protective wall 76, 77 in a retracted state. The impetus is provided by a scissor mechanism consisting of two levers 78 and 79, by a telescopic extendable cylinder 80 or by another driving system. In FIG. 5*b*, the two levers 78 and 79 are driven by the cylinder 81. An even simpler solution would be to fix the levers on one side by a fixed bearing and on the other side by a floating bearing and to drive the scissor mechanism by a spindle at the lower floating bearing.

In FIG. 5*b*, there is a reception element 9, for example a tube, on the left- and right-hand side of the railway station underpass 83. This reception element 9 holds the pole 8 and can be used for guiding the pole 8. The reception element 9 represents a vertical guide rail. The pole 8 is connected with the protective wall 76, 77 and stabilizes them. The stability of the protective wall 76, 77 can be increased against curvature, kinks and other deformations using one or more of these poles 8.

Figure 5C:
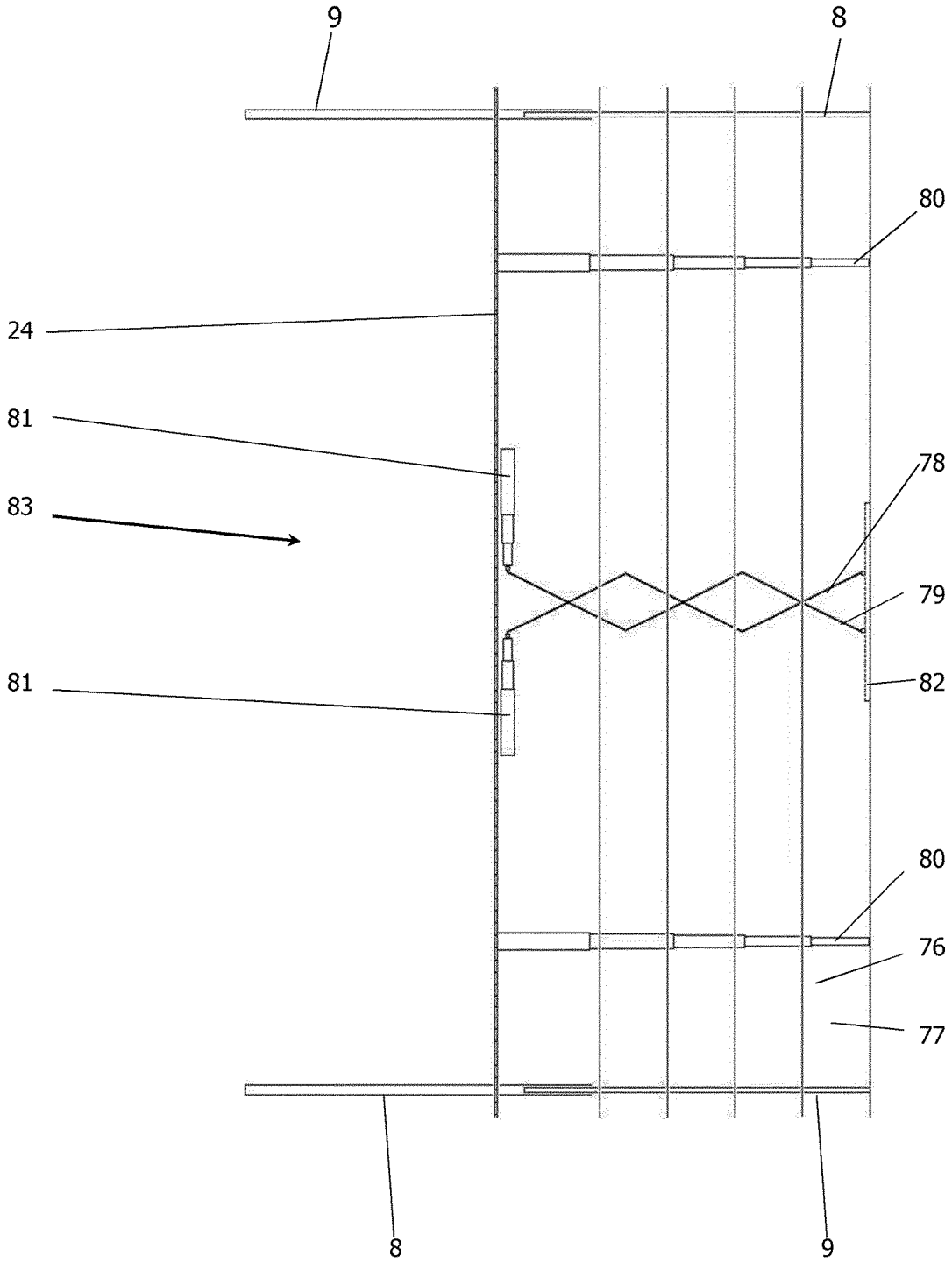

FIG. 5*c* shows the cross section of an embodiment with a multi-part extendable protective wall 76, 77 in an extended state.

Figure 5D:
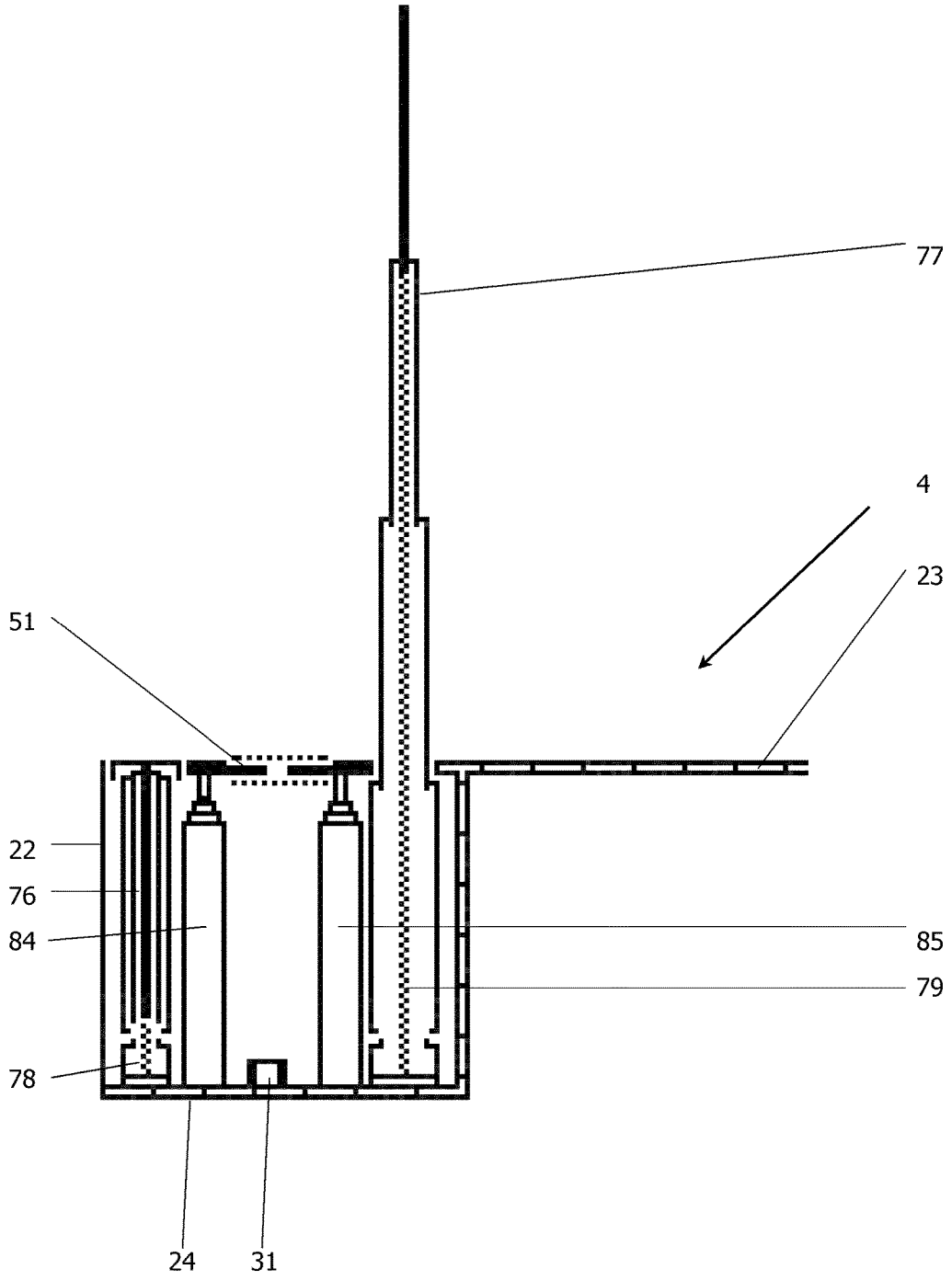

FIG. 5*d* shows the cross section of a platform with two integrated multi-part extendable protective walls 76, 77 and an intermediate element 51 described in FIG. 3*d* in between. In FIG. 5*d*, the tilting and the vertical motion of the extendable intermediate element 51 are driven by a telescopic extendable cylinder 84, 85. The telescopic extendable cylinder 84 is connected to the frame components closer to the track. The telescopic extendable cylinder 85 is connected to the frame components closer to the platform. The extendable intermediate element 51 can be steered during the lifting and lowering process along the vertical guide rails on the side of the outer protective wall closer to the platform and/or along the vertical guide rails on the side of the inner protective wall closer to the rail track. The chronological sequence of the vertical movements of the multi-part extendable outer protective wall 76, of the extendable intermediate element 51 and of the inner protective wall 77 according to FIG. 5*d* is the same as the movement described in FIG. 3*d*.

Figure 5E:
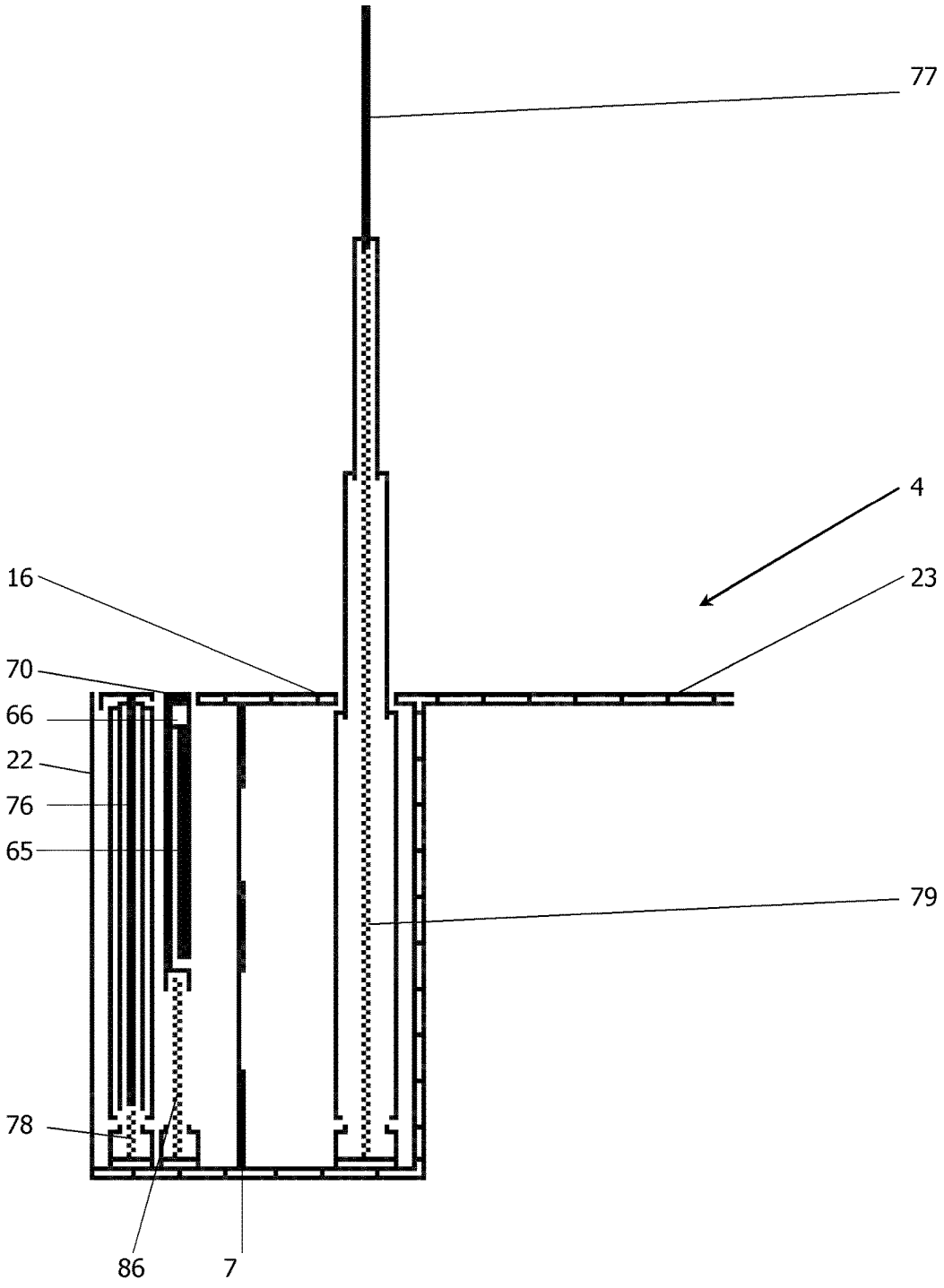

FIG. 5*e* represents a cross section of a platform with two integrated multi-part extendable protective walls 76, 77 and a hinged flap 65 as shown in FIG. 4*c* which is installed on a separate support element. The purpose of the hinged flap 65 is to push people standing on the platform 4 safely to the platform-oriented side of the inner protective wall during the extension of the multi-part extendable inner protective wall 12. The vertical movement of the support element 70 is driven by a driving mechanism 86 which can be represented by a scissor mechanism, a telescopic extendable cylinder or another driving system, and which can have a much smaller vertical extent in the retracted state than in the extended state. A sensor and a fixation at the rear wall of the support element 70 ensures that the support element 70 retracts only if the hinged flap 65 is in a pulled-back state. The potential drive for the push-out movement of the hinged flap 65 is the same as the one described in FIG. 4*c*. The length of the hinged flap 65 should at least match the length suitable to cover the distance between the multi-part extendable outer protective wall 76 and the multi-part extendable inner protective wall 77 in the inclined pushed-out state. The design of the hinged flap 65 can also be longer and can overtop the multi-part extendable inner protective wall 77 during the lifting process over the extendable inner protective wall 77. The support element 70 can be steered along the vertical guide rails in the platform-oriented lowest plate of the multi-part extendable outer protective wall 76. In the area of railway station underpass, it is also possible that, on the left- and right-hand side of the underpass, the support element 70 is steered along the vertical guide rails on the side closer to the platform of the outer protective wall 11.

The chronological sequence of the vertical movement of the multi-part extendable outer protective wall 76, of the support element 70 and of the multi-part extendable inner protective wall 77, as well as the push-out and the pull-back movements of the hinged flap 65 in FIG. 5*e* and the functioning of the drive 66 are the same as is shown in FIG. 4*c*.

Figure 5F:
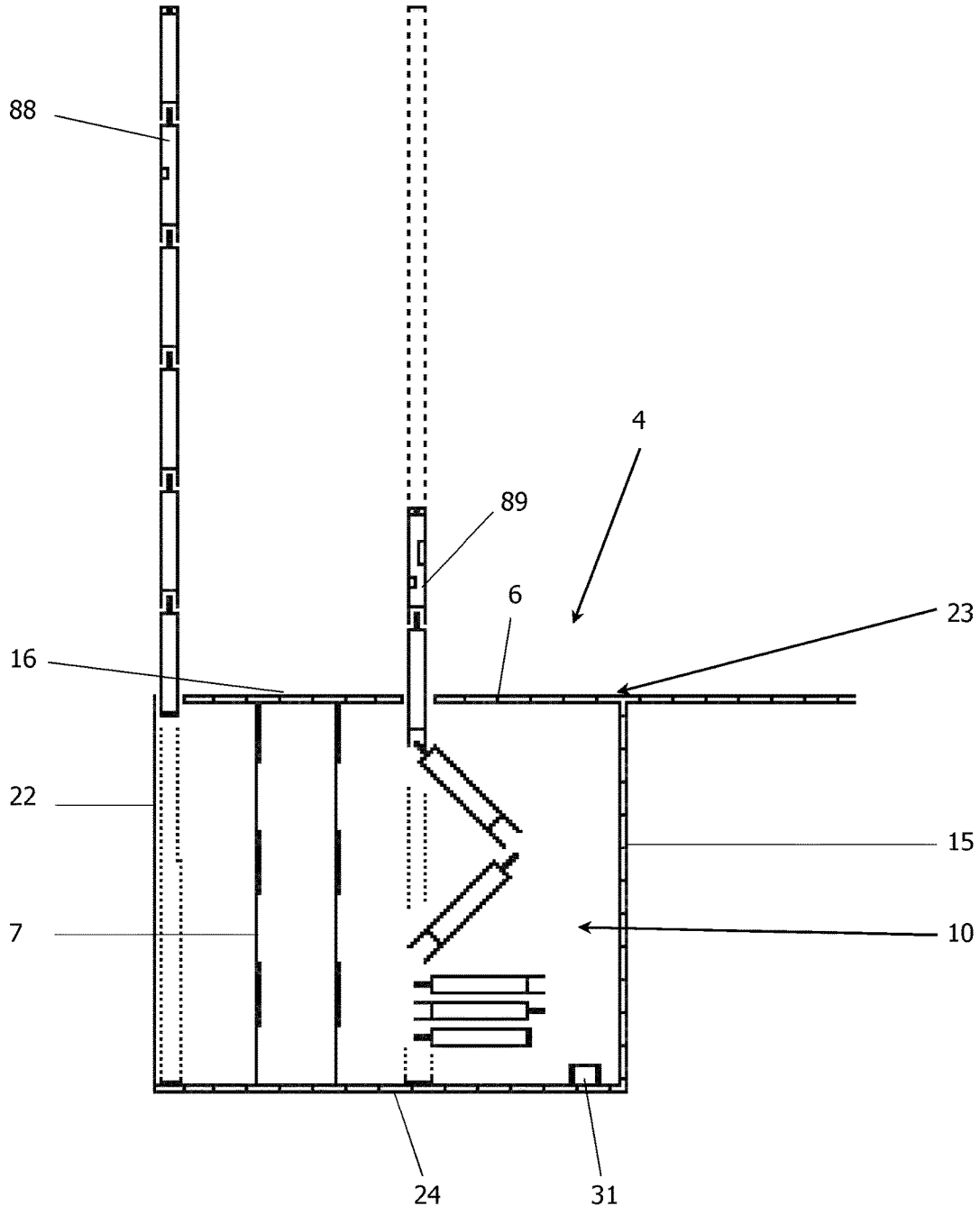

FIG. 5*f* represents the cross section of a platform where the outer protective wall 88 and the inner protective wall 89 consist of intermateable wall elements. This embodiment is beneficial if there is not much space below the platform plateau 23. Because the intermateable wall elements can be piled horizontally on top of each other in a retracted state, the vertical extent is very small in the retracted state. The intermateable wall elements are held together by a continuous rope. The topmost wall element is connected with a drive, for example a telescopic extendable cylinder. The topmost wall element can also be pulled up along a vertical pole in the area of railway station underpasses. The poles can be placed on the left- and right-hand side of the station underpass, that is, in an area where there is enough space beneath the platform plateau for a linear vertical drive. To push people standing on the platform 4 safely to the platform-oriented side of the intermateable inner protective wall 89 during the upward movement of the intermateable inner protective wall 89, a system with an extendable intermediate element 51 as shown in FIG. 3*d* or a system with a hinged flap 65 as shown in FIG. 4*c* can be installed. Reference signs shown in this example which are not described correspond to the corresponding components of the figures before.

Figure 6A:
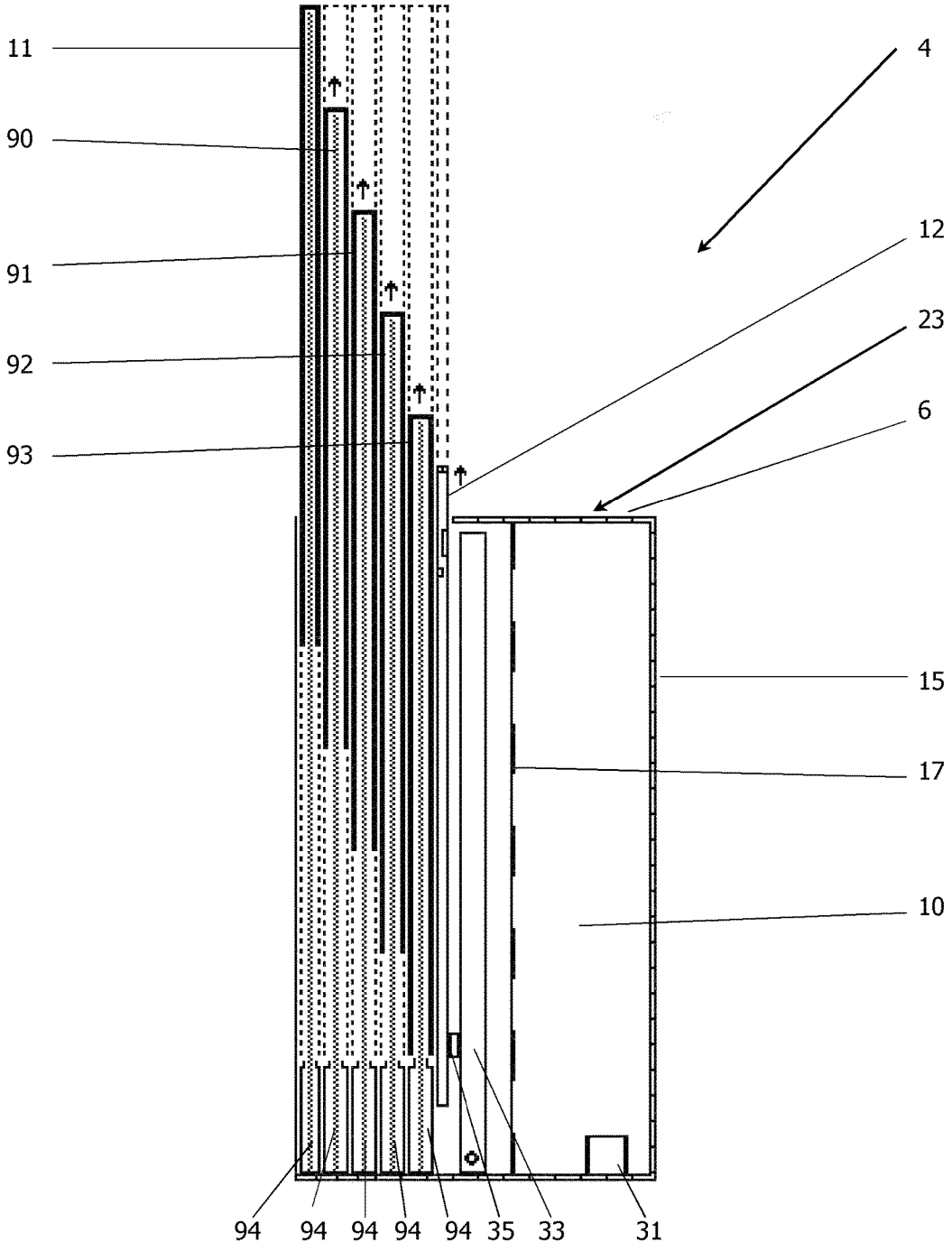

The embodiment according to FIG. 6*a* shows the retractable intermediate walls 90, 91, 92, 93 between the outer protective wall 11 and the inner protective wall 12 to push people standing on the platform to the platform-oriented side of the inner protective wall 12 during the lifting process of the inner protective wall 12. Instead of four retractable intermediate walls 90, 91, 92, 93 between the outer protective wall 11 and the inner protective wall 12, it is also possible to have a system with one, two, three, five or more retractable intermediate walls between the outer protective wall 11 and the inner protective wall 12. The retractable intermediate walls 90, 91, 92, 93 have to form a complete closure on the side closer to the platform and facing the passengers. The intermediate walls 90, 91, 92, 93 can be hollow on the inside and open on the side facing the rail tracks. The motion of extension and retraction of each intermediate wall 90, 91, 92, 93 is supported with a driving mechanism 94. The driving mechanism 94 is largely located inside each intermediate wall 90, 91, 92, 93. A driving mechanism 94 can be a cross-cutter drive, a telescopic extendable cylinder or another driving system. The driving mechanism of the outer protective wall 11 is also largely located inside the outer protective wall 11. The inner protective wall 12 can be driven by a mechanism located inside the inner protective wall 12 or by a linear vertical drive 33.

As the retractable intermediate walls 90, 91, 92, 93 between the outer protective wall 11 and the inner protective wall 12 represented by the embodiment in FIG. 6*a* have the same function like the extendable intermediate element 51 in FIG. 3*d* or the hinged flap 65 in FIG. 4*c*, the chronological sequence of the vertical movements of the outer protective wall 11, of the intermediate walls 90, 91, 92, 93 and of the inner protective wall 12 are as follows:

After completion of the passenger exchange, the outer protective wall 11 gets lifted. After the outer protective wall 11 is completely extended or so far extended that nobody can fall from platform 4 onto the rail tracks, the retractable intermediate wall 90 directly next to the outer protective wall 11 will start to get lifted. When the retractable intermediate wall 90 is partly extended, the retractable intermediate wall 91 next to the retractable intermediate wall 90 starts to extend. Meanwhile, the retractable intermediate wall 90 continues to extend. When the retractable intermediate wall 91 is partly extended, the retractable intermediate wall 92 next to the retractable intermediate wall 91 starts to extend, and so forth until the retractable intermediate wall directly next to the inner protective wall 12. When the retractable intermediate wall 93 directly next to the inner protective wall 12 is in the extended state, the inner protective wall 12 starts to extend. The inner protective wall 12 is moved by a vertical drive 33. When the inner protective wall 12 is extended so far that the rail track area is securely separated from the platform area, the outer protective wall 11 and the retractable intermediate walls 90, 91, 92, 93 can be lowered. At that point in time, only the inner protective wall 12 is in the extended state, rail vehicles can pass through at a high speed along the platform. If the last rail vehicle without stop at the platform has left the track area at the platform and if the next rail vehicle is going to be a rail vehicle with a scheduled stop at the platform and with passenger exchange, then the outer protective wall 11 can start to get lifted as shown in FIG. 2*h*. At this point in time, the intermediate walls 90, 91, 92, 93 remain in the extended state, since no passengers have to be pushed away. After the inner protective wall 12 has been retracted as shown in FIG. 2*i*, the outer protective wall 11 will start to lower before the passenger exchange until it is in the retracted state.

Figure 6B:
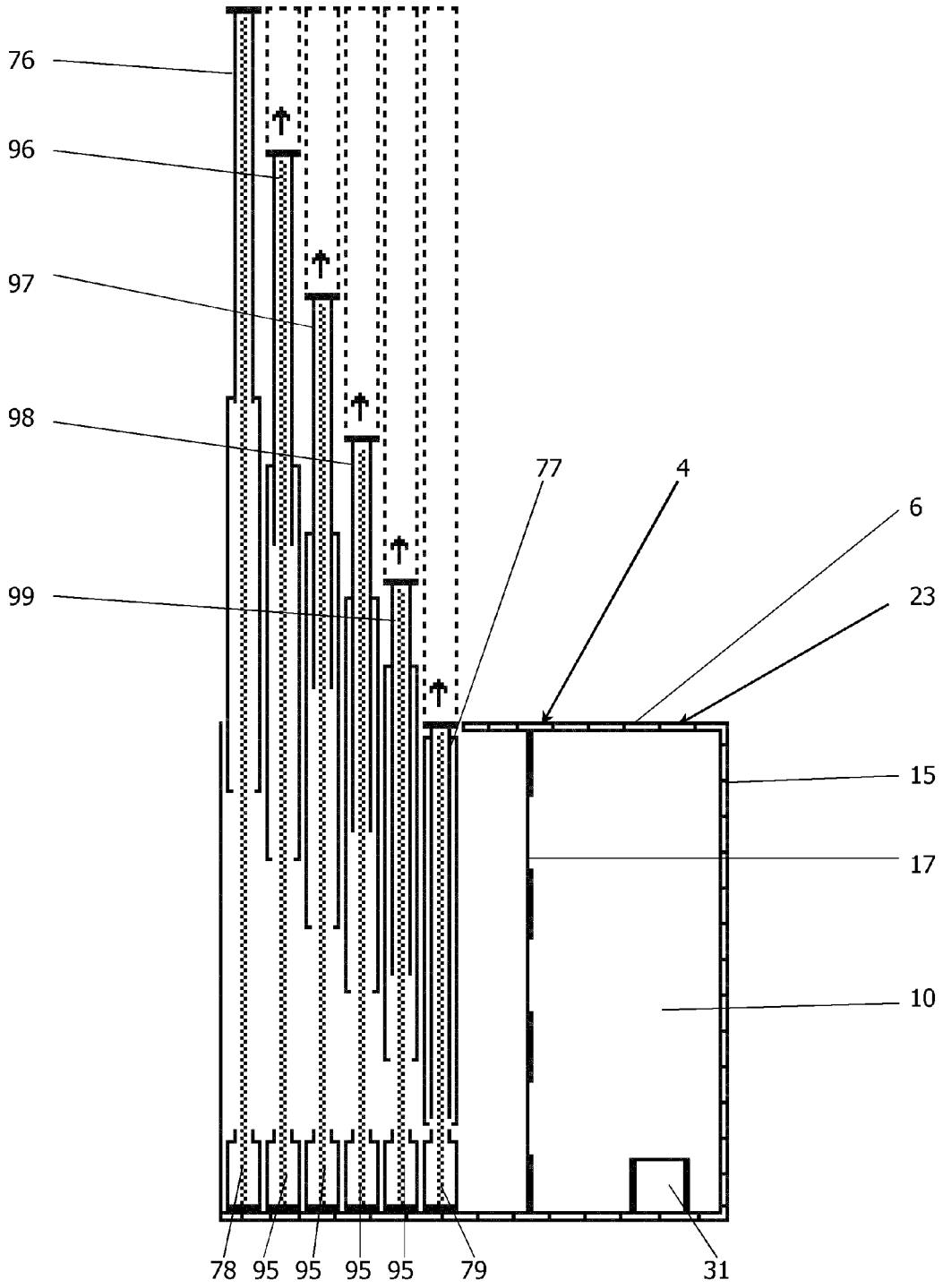

The embodiment in FIG. 6*b* is an alternative for the embodiment in FIG. 6*a* in case of limited space beneath the platform plateau 23. In the embodiment in FIG. 6*b*, there are multi-part extendable intermediate walls 96, 97, 98, 99 between the multi-part extendable outer protective wall 76 and the multi-part extendable inner protective wall 77 in order to push people standing on the platform 4 to the platform-oriented side of the multi-part extendable inner protective wall 77 during the lifting process of the multi-part extendable inner protective wall 77. A characteristic of the embodiment in FIG. 6*b* is that the multi-part extendable protective walls 76, 77 and the multi-part extendable intermediate walls 96, 97, 98, 99 have a much smaller vertical extent in the retracted state than in the extended state.

Instead of four multi-part extendable intermediate walls 96, 97, 98, 99, it is also possible to have a system with only one, two three or five multi-part extendable intermediate walls between the multi-part extendable outer protective wall 76 and the multi-part extendable inner protective wall 77. The multi-part extendable intermediate walls 96, 97, 98, 99 have to form a complete closure on the side which is closer to the platform and which is facing the passengers, the multi-part extendable intermediate walls 96, 97, 98, 99 can be hollow on the inside and open on the side facing the rail tracks. The upward- and downward movement of each multi-part extendable intermediate wall 96, 97, 98, 99 is supported with a driving mechanism 95. The driving mechanism 95 is largely located inside each multi-part extendable intermediate wall 96, 97, 98, 99. The driving mechanism 78 of the multi-part extendable outer protective wall 76 is largely located inside the multi-part extendable outer protective wall 76, the driving mechanism 79 of the multi-part extendable inner protective wall 77 is largely located inside the multi-part extendable inner protective wall 76. A driving mechanism 78, 79, 95 can be a cross-cutter drive, a telescopic extendable cylinder or another driving system.

The chronological sequence of the motion of extension and retraction of the multi-part extendable outer protective wall 76, of the multi-part extendable inner protective wall 77 and of the multi-part extendable intermediate wall 96, 97, 98 in FIG. 6*b* is the same as in the embodiment in FIG. 6*a*.

Figure 7A:
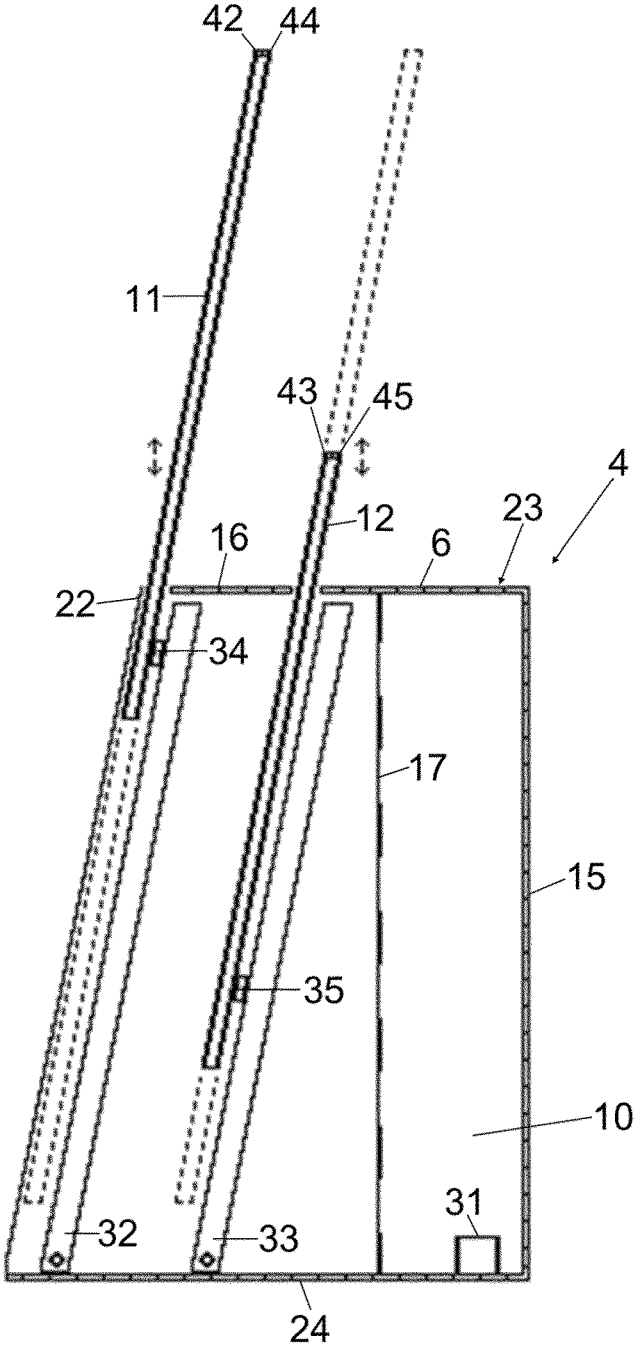

FIG. 7*a* shows an embodiment for platforms which are located in the area of strongly inclined inward curves of the rail tracks. Depending on the radius of the bend, rail track bends can exhibit a lateral inclination. Thus, rail vehicles can exhibit a lateral inclination in the areas of inward curves. In order to prevent a contact of the rail vehicle with the outer protective wall 11 or the inner protective wall 12, the outer protective wall 11 and the inner protective wall 12 can also be inclined. FIG. 7*a* depicts the cross section of a platform with two integrated tilted protective walls 11, 12.

The platform edge 22, the outer protective wall 11, the linear vertical drive 32, the inner protective wall 12 and the linear vertical drive are tilted. The linear vertical drives 32, 33 are fixed to the floor 24 of the shell 15. Between the outer protective wall 11 and the inner protective wall 12, it's possible to install a system described in FIG. 3*a*-3*d*, 4*a*-4*c* or 6*a* to push people standing on the platform 4 safely to the platform-oriented side of the inner protective wall 12 before or during the lifting process of the inner protective wall 12. The chronological sequence of the movements of the outer protective wall 11 and the inner protective wall 12 after completion of the passenger exchange, while rail vehicles without a scheduled stop pass the platform 4 at high speed and before the complete standstill of rail vehicles with a scheduled stop at the platform 4 are the same as described in the embodiment according to FIGS. 2*a*-2*m*.

Figure 7B:
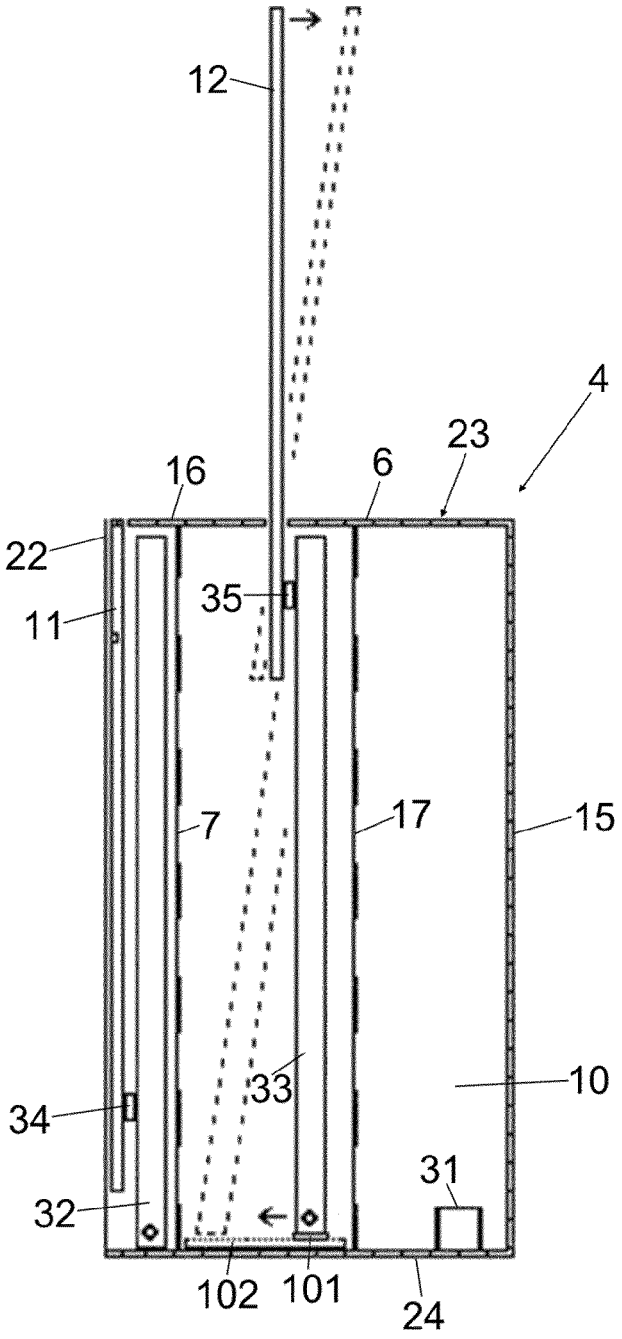
Figure 7C:
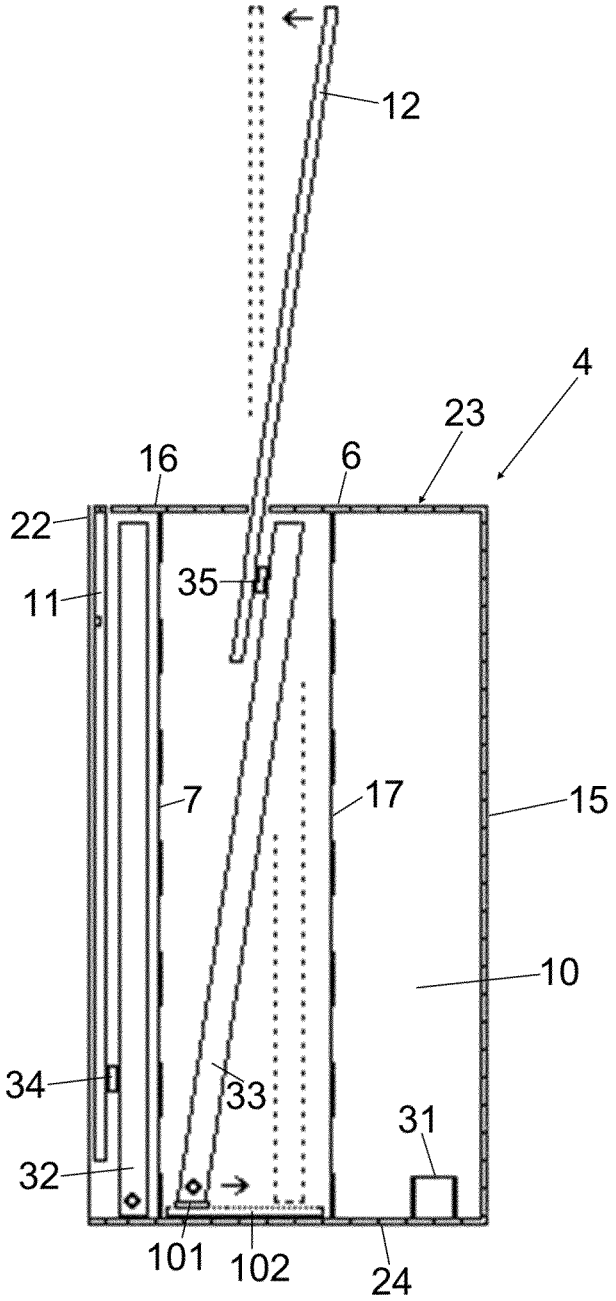

The embodiment according to FIGS. 7*b*, 7*c* shows an embodiment in which the inner protective wall 12 in the extended state can be inclined in the direction towards the platform. For this reason a tilting device is provided to bring at least one of the protective walls to a tilted position. For this purpose the linear vertical drive 33 of the inner protective wall 12 is mounted on a carriage 101 which can slide along a rail by a linear horizontal drive. The carriage 101 or the linear vertical drive 33 have hinges at the lower corners. Thanks to a pivot point on the level of the platform plateau 23, the inner protective wall 12 in the extended state is inclined towards the platform as soon as the carriage 101 moves in direction of the platform edge. The inner protective wall comes back to its originally vertical position as soon as the carriage 101 moves back towards its original position near the rear wall of the shell 15. The linear vertical drive 32 of the outer protective wall is fixed on the floor 24 of the shell 15, the outer protective wall has always a vertical alignment. Between the outer protective wall 11 and the inner protective wall 12 a system as described in FIG. 3*a*-3*d*, 4*a*-4*c* or 6*a* can be installed to push people standing on the platform 4 safely to the platform-oriented side of the inner protective wall 12 before or during the lifting process of the inner protective wall 12. The advantage of an embodiment according to FIGS. 7*b*, 7*c* is, that in the extended and tilted state of the inner protective wall 12 with increasing height a greater distance between the inner protective wall 12 and the wagon wall of passing rail vehicles is formed. Thereby, the compressed air pressure can be reduced more easily. The inner protective wall can be placed closer to the platform edge, which can be an advantage in case of narrow central platforms or where limited spatial circumstances exist because of staircases and passenger lifts on the platform.

The chronological sequence of the vertical movements of the outer protective wall 11 and the inner protective wall 12 in the embodiment according to FIGS. 7*b*, 7*c* is the same like in the embodiment according to FIGS. 2*a*-2*m*. If only the inner protective wall 12 is in the extended state in the embodiment according to FIGS. 7*b*, 7*c*, the inner protective wall 12 tilts towards the platform. For that reason, the chronological sequence of the vertical movements of the outer protective wall 11 as well as the vertical movements and the tilting process of the inner protective wall in the embodiment according to FIGS. 7*b*, 7*c* is as follows:

After completion of the passenger exchange, the outer protective wall 11 gets lifted. Are the passengers pushed to the platform-oriented side of the inner protective wall 12 and is the inner protective wall 12 in the extended state, so the outer protective wall 11 and the system described in FIG. 3*a*-3*d*, 4*a*-4*c* or 6*a* can be lowered. Now only the inner protective wall 12 is in the extended protection state. Now the inner protective wall 12 starts to be inclined towards the platform like shown in FIG. 7*b*. For this purpose the carriage 101, and in this way also the lower part of the linear vertical drive 33, moves along a rail 102 towards the platform edge 22. The pivot point the inner protective wall 12 is on the level of the platform plateau 23, the inner protective wall 12 is fixed on the level of the platform plateau 23 between the plate 16 and the plate 6. Thanks to a notch in the platform-oriented side of the inner protective wall 12 on the level of the platform plateau 23 and a counterpart in the plate 6 the tilting movement can be facilitated. If the inner protective wall 12 in an inwardly tilted position, there is in the upper area of the inner protective wall 12 a greater distance between the wagon wall of passing rail vehicles and the inner protective wall 12. The compressed air pressure can be reduced more easily. At this stage, rail vehicles can pass at high speed at the platform. If the last rail vehicle without a scheduled stop at the platform has left the track area beside the platform and the next rail vehicle will be a rail vehicle with a scheduled stop at the platform and passenger exchange, the outer protective wall can get lifted like shown in FIG. 2*h*. At this moment, no persons have to be pushed away, the systems, as described in FIG. 3*a*-3*d*, 4*a*-4*c* or 6*a*, remain in the retracted state. Before the inner protective wall 12, like shown in FIG. 2*i*, can be lowered, it's better that that the inner protective wall 12 moves back to its originally vertical position like shown in FIG. 7*c*. For this purpose the carriage 101, and in this way also the lower part of the linear vertical drive 33, slides along a rail 102 back towards the rear wall of the shell 15. If the inner protective wall 12 is again in a vertical position and in the retracted state, before the passenger exchange also the outer protective wall 11 is lowered to the retracted state.

Figure 8A:
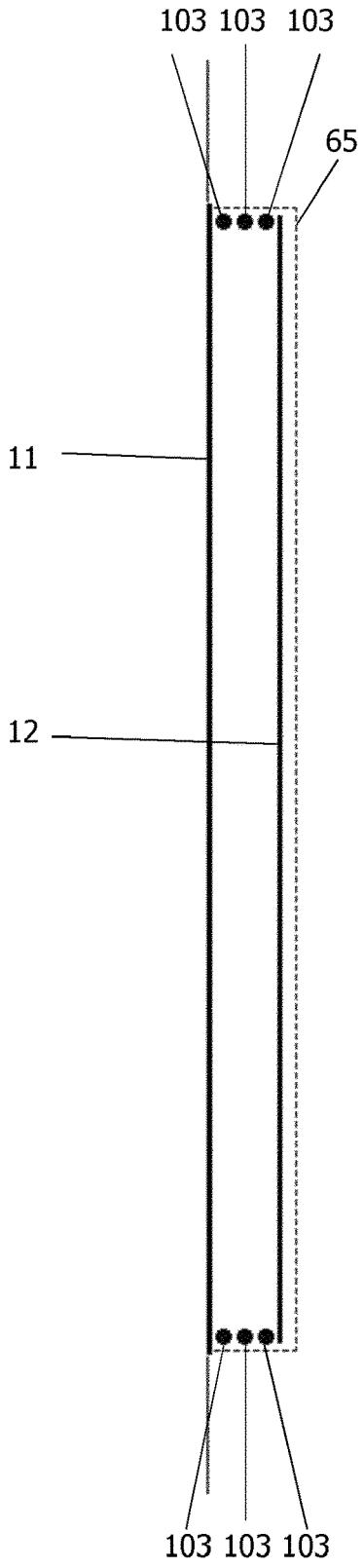
FIG. 8*a* an eighth embodiment, the view from above with the outer protective wall, the inner protective wall, the flap and the retractable bollards if the protective wall system should cover only a part of the platform, FIG. 8*b* the eighth embodiment, the view from above with the outer protective wall, the inner protective wall, the extendable intermediate element and the bollards if the protective wall system should cover only a part of the platform.
Figure 8B:
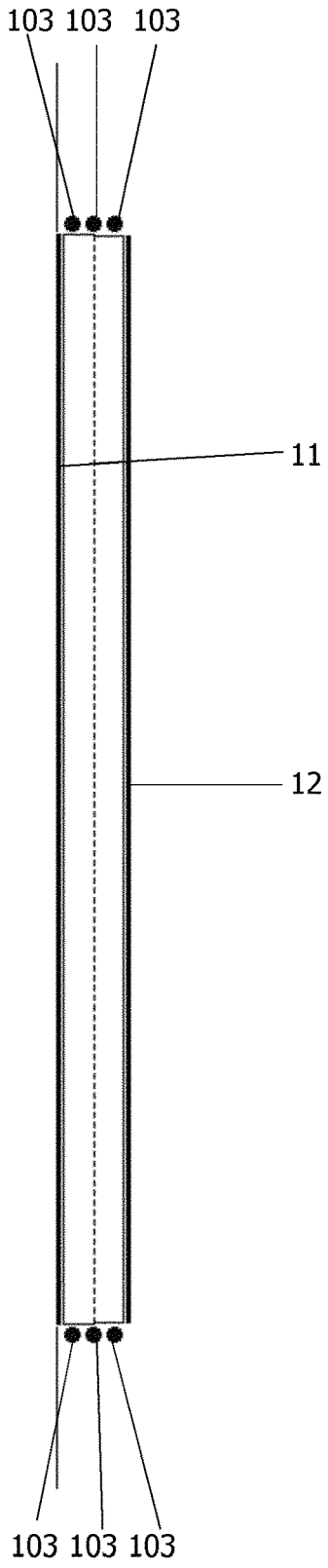

FIG. 8*a* and FIG. 8*b* show a view from above of an embodiment comprising retaining elements, which prevent that passengers can enter the space between the inner protective wall 12 and the outer protective wall 11. This retaining elements can be for example extendable bollards 103 between the outer protective wall 11 and the inner protective wall 12, the extendable bollards are placed as a lateral completion of the protective wall system. For financial reasons, it can happen that the railway company wants to equip only a part of the platform with a protective wall system and leave the other part of the platform open as before. In the situation presented in FIG. 2*g* in which the outer protective wall is in the retracted state and the inner protective wall is in the extended state, i.e. the situation while rail vehicles pass the platform at high speed, it has to ensured that no person can get from the open part into the space between the inner protective wall 12 and the platform edge. For that reason, the protective wall system has a lateral closure by means of extendable bollards 103. Instead of extendable bollards, also poles which be lifted can form the lateral closure. Each pole could be connected with its own drive or similar to a fork many poles could be mounted on a bar, so that a drive could move many poles at the same time. The distance between the lateral bollards should be small enough, so that young children can't pass.

Is there a system installed like presented in FIGS. 3*a*-3*d* or FIG. 6*a* to push people standing on the platform 4 safely to the platform-oriented side of the inner protective wall 12 during the lifting process of the inner protective wall 12, in this case the extendable bollards 103 are placed next to the extendable intermediate element 51, respectively next to the extendable intermediate walls 90, 91, 92, 93, as shown in FIG. 8*b*. Is there a system installed like presented in FIGS.

4*a*-4*c*, the extendable bollards 103 are placed advantageously inside the area which is covered by the hinged flap 65, as shown in FIG. 8*a*.

If there is an installation of a system like described in FIGS. 4*a*-4*c*, the chronological sequence of the vertical movements of the lateral bollards 103, the outer protective wall 11 and the inner protective wall 12 as well as the push-out and pull-back movement of the hinged flap are as follows:

After completion of the passenger exchange, the outer protective wall 11 gets lifted by the linear vertical drive 32. Is the hinged flap 65 completely above the level of the platform plateau 23, the hinged flap starts to be pushed-out. By the push-out movement of the hinged flap 65 people standing on the platform are pushed safely to the platform-oriented side of the inner protective wall 12. The lateral bollards 103 are now situated below the hinged flap 65. Advantageously the upward movement of the lateral bollards 103 follow the push-out movement of the hinged flap 65, that means that the bollard next to the track gets lifted first, the bollard with the smallest distance to the platform edge gets lifted last. In this way a gap between the hinged flap 65 and the lateral bollards 103 can be avoided. The lateral bollards 103 can also act as a support for the push-out movement of the hinged flap 65. In the further process the hinged flap 65, the lateral bollards 103 and the inner protective wall move upwardly with the same speed. If the inner protective wall 12 is lifted sufficiently to separate the track area from the platform area, the linear vertical drive 33 stops the upward movement of the inner protective wall 12. Also the upward movement of the lateral bollards 103 is stopped. The hinged flap 65 continues to move upwards a little further until it can be pulled back. The hinged flap 65 is completely pulled-back and the outer protective wall 11, respectively depending of the embodiment also the support element 70, can be completely lowered. At this point in time, only the inner protective wall 12 and the lateral bollards 103 are in the extended state. People can't enter the space between the inner protective wall 12 and the platform edge 22. Now rail vehicles can pass the platform at high speed. Has the rail vehicle without a scheduled stop at the platform left the track area beside the platform and will the next rail vehicle be a rail vehicle with a scheduled stop at the platform and passenger exchange, the outer protective wall can get lifted like shown in FIG. 2*h*. At this moment, no persons have to be pushed away, the hinged flap 65 remains in the pulled-back state. After the inner protective wall 12 and the lateral bollards 103 are lowered, before the passenger exchange also the outer protective wall 11 is lowered again into the retracted state. If there is an installation of a system as described in FIGS. 3*a*-3*d*, the chronological sequence of the vertical movements of the lateral bollards 103, the outer protective wall 11, the extendable intermediate element 51 and the inner protective wall 12 in the embodiment according to FIG. 8*b* are as follows: After completion of the passenger exchange, the outer protective wall 11 gets lifted. Is the outer protective wall in the extended state or lifted sufficiently high that no persons can fall no more from the platform 4 into the track area, the track-oriented frame component of the extendable intermediate element 51 gets lifted by the upward movement of the carriage or by the pole 54 so high, until the inclination is steep enough that in the further process people standing on the platform are pushed safely to the platform-oriented side of the inner protective wall. Advantageously, the upward movements of the lateral bollards follow the movement of the extendable intermediate element 51, that means that the bollard next to the platform edge gets lifted first, the bollard with the greatest distance to the platform edge gets lifted last. In this way a gap between the extendable intermediate element 51 and the lateral bollards can be avoided. In the further process the extendable intermediate element 51, the lateral bollards 103 and the inner protective wall 12 move upwards with the same speed. Has the inner protective wall 12 reached the extended protection state, the outer protective wall 11 and the extendable intermediate element 51 can be lowered to the level of the platform plateau. Now, only the inner protective wall 12 and the lateral bollards 103 are in the extended state. Persons can't enter the space between the inner protective wall 12 and the platform edge 22. Now rail vehicles can pass the platform at high speed. If the last rail vehicle without a scheduled stop at the platform has left the track area beside the platform and the next rail vehicle will be a rail vehicle with a scheduled stop and passenger exchange, the outer protective wall 11 can get lifted as shown in FIG. 2*h*. At this moment no persons have to be pushed away, for that reason the extendable intermediate element 51 remains on the level of the platform plateau. After the inner protective wall 12 and the lateral bollards 103 are lowered, also the outer protective wall 11 is lowered to the extended to the retracted state before the passenger exchange. If there is an installation of a system as described in FIG. 6*a*, the chronological sequence of the vertical movements of the lateral bollards 103, the outer protective wall 11, the extendable intermediate walls 90, 91, 92, 93 and the inner protective wall 12 is the same like in the embodiments described in FIGS. 3*a*-3*d*. Advantageously the lifting process of the lateral bollards 103 follows the upward movements of the extendable intermediate walls 90, 91 92, 93.

The invention claimed is:

1. A protection device for protection of people in a station area from moving rail vehicles, whereby the station area contains at least one platform, whereby the platform contains at least one platform edge and on a first side of the platform edge tracks for a rail vehicle are arranged and on a second side of the platform edge a platform plateau is located, as a waiting area for people, whereby a protective wall is situated directly adjacent or near to the platform edge and is movable between a retracted state and an extended state adjustably in such a way that in the extended state of the protective wall an access to the tracks is obstructed, in the retracted state the access to the tracks is free, characterized in that the protective wall comprises an inner protective wall and an outer protective wall, whereby at least one of the inner and outer protective walls in the retracted state is housed in a cavity, whereby the cavity is situated below the platform plateau, whereby one of the inner and outer protective walls is equipped with a hinged flap configured to extend into a space above the platform plateau between the inner and outer protective walls, such that the space between the inner and outer protective walls is configured to be covered by the hinged flap; wherein the inner and outer protective walls are configured to move linearly and independently between the retracted and extended states.

2. The protection device according to claim 1, whereby the outer protective wall is installed between the platform edge and the inner protective wall or the outer protective wall forms the platform edge or is installed directly adjacent to the platform edge.

3. The protection device according to claim 1, whereby the inner and outer protective walls contain a driving device.

4. The protection device according to claim 1 whereby in the cavity a pillar is arranged, which is configured to serve as a support for a removable plate element.

5. The protection device according to claim 3, whereby the driving device contains at least a drive cylinder or a vertical drive.

6. The protection device according to claim 1, whereby the space is provided between the outer protective wall and the inner protective wall and a mechanical system is arranged to seal the space between the outer protective wall and the inner protective wall.

7. The protection device according to claim 6, whereby the mechanical system is formed as an extendable intermediate element.

8. The protection device according to claim 1, whereby the hinged flap is integrated into in the outer protective wall or is fixed on a separate support element.

9. The protection device according to claim 8, whereby a sensor is provided on at least one of the inner and outer protective walls or at the hinged flap.

10. The protection device according to claim 8, whereby a fixation element is provided at a side surface of the outer protective wall or at the support element, so that the outer protective wall or the support element only can be lowered if the hinged flap is in a pulled-back state.

11. The protection device according to claim 8, whereby a length of the hinged flap corresponds at least to a distance between the outer protective wall and the inner protective wall.

12. The protection device according to claim 8, whereby a push-out movement of the hinged flap is caused by a drive at a mounting of the hinged flap on the outer protective wall at an upper end of the hinged flap.

13. The protection device according to claim 1, whereby at least one of the inner or outer protective walls comprises a plurality of parts.

14. The protection device according to claim 13, whereby at least one of the inner or outer protective walls comprises a plurality of intermateable wall elements.

15. The protection device of claim 1 wherein the inner and outer protective walls move vertically between the retracted state and the extended state.

* * * * *